US005707061A

United States Patent [19]

Ikeda et al.

[11] Patent Number: 5,707,061

[45] Date of Patent: Jan. 13, 1998

[54] GAME APPARATUS USING AN OBJECT OF WHICH MOVEMENT DETERMINES A RESULT OF A GAME

[75] Inventors: Yuji Ikeda; Yasuo Jin, both of Tokyo, Japan

[73] Assignee: Sega Enterprises, Ltd., Tokyo, Japan

[21] Appl. No.: 527,894

[22] Filed: Sep. 14, 1995

[30] Foreign Application Priority Data

Sep. 19, 1994 [JP] Japan ..... 6-223828
Sep. 19, 1994 [JP] Japan ..... 6-223829

[51] Int. Cl.[6] ..... A63F 9/04

[52] U.S. Cl. ..... 273/145 R; 273/129 V; 273/138.2; 124/79

[58] Field of Search ..... 273/129 V, 129 S, 273/108, 145 R, 138.2, 138.1, 145 C; 124/79; 446/308, 309

[56] References Cited

U.S. PATENT DOCUMENTS

| | | | |
|---|---|---|---|
| 2,044,994 | 6/1936 | Pierce | 273/145 R |
| 2,657,057 | 10/1953 | Chapin | 273/145 R |
| 3,003,767 | 10/1961 | Keuls | 124/79 |
| 3,516,672 | 6/1970 | Maurer | 273/145 C |
| 4,513,967 | 4/1985 | Halford et al. | 273/129 V |
| 5,031,913 | 7/1991 | Hirosumi et al. | 273/145 R |
| 5,259,613 | 11/1993 | Marnell, II | 463/42 |
| 5,263,715 | 11/1993 | Matsumoto et al. | 463/22 |

FOREIGN PATENT DOCUMENTS

| | | |
|---|---|---|
| 54-62033 | 5/1979 | Japan . |
| 55-86487 | 6/1980 | Japan . |
| 1-198576 | 8/1989 | Japan . |
| 3-146082 | 6/1991 | Japan . |
| 5-42256 | 2/1993 | Japan . |
| 5-212158 | 8/1993 | Japan . |
| 1180560 | 2/1970 | United Kingdom . |

OTHER PUBLICATIONS

Shake, Rattle 'n Roll, The Washington Post, Sunday Nov. 12, 1972, p. 19, Advertising Supplement.

*Primary Examiner*—Benjamin H. Layno
*Attorney, Agent, or Firm*—Price, Gess & Ubell

[57] ABSTRACT

A game apparatus offers a game played by a plurality of players. The game apparatus uses an object having means for determining a result of the game, the result of the game being dependent on a movement of the object, a moving process of the object being observed by the players. Magnitude information indicative of a magnitude determined by one of the players is generated and detected in the game apparatus. A driving force is applied to the object so that the object is thrown toward a field defined by the game apparatus. A magnitude of the driving force is controlled in accordance with the magnitude of the hitting force. The object is collected by a collecting member moving on the field from a rear side to a front side. A pair of attracting members are provided on the front side of the field and move in opposite directions. The object is sandwiched between the attracting members and, thus, the object is placed on a throwing plate positioned in the center of the front side of the field.

40 Claims, 22 Drawing Sheets

GAME APPARATUS USING AN OBJECT OF WHICH MOVEMENT DETERMINES A RESULT OF A GAME

BACKGROUND OF THE INVENTION

1) Field of the Invention

The present invention generally relates to game apparatuses and, more particularly, to a game apparatus having a plurality of operational stations so that a plurality of players can jointly play a game performed by the game apparatus.

2) Description of the Related Art

A conventional game apparatus, which provides a game played by a plurality of players, is generally managed by a computer provided in the game apparatus. In a game offered by such a game apparatus, a plurality of players guess a result of an action, such as that performed in a dice game. In the game apparatus, the result of the action is determined by a calculation performed by the computer.

Such a game apparatus has a plurality of operational stations (hereinafter referred to as satellites) so that each of the players can play at his or her own satellite. Each of the satellites has a display unit and an input unit. Guidance of a game or a result of the game is displayed on the display unit. The player can input information to the game apparatus through the input unit.

In the above-mentioned conventional game apparatus, the determination of the result of the game is controlled only by the game apparatus (strictly, the computer in the game apparatus). The game is performed as if a plurality of players are jointly playing, but the game is actually performed by the game apparatus and each of the players individually. As a result, each of the players feels emotions, i.e., excitement at winning or frustration at loosing, not against other players but against the game apparatus only. Accordingly, no communication is produced between the players despite the fact that the plurality of players are playing the same game. This reduces some enjoyment of playing the game even though the game can be played by a plurality of players. Thus, the object of the game apparatus cannot be fully achieved.

Additionally, in a game apparatus which determines a result of the game only by the game apparatus, it may be difficult for each of the players to feel they have received fair or equal treatment by the game apparatus. That is, some players, particularly players whose expectation did not come true, may suspect that the result of the game directed to their own satellite was intentionally determined to be uneven or unfair.

U.S. Pat. No. 5,263,715 to Matumoto et al. discloses a dice displaying apparatus for a computer game machine having a display showing a rolling of one of the dice. This game machine has six control panels so that six players can play jointly. Each of the control panels is provided with a trackball which can be rotated by the player. The game machine has a CRT display on which motion of one of the dice is displayed. To play with this game machine, each of the players guesses a number to be shown by the dice and inputs the number through their own control panel. One of the players is then selected by the game machine, and the selected player rotates the trackball of his/her own panel. The apparatus detects a rotational direction and a rotational speed of the trackball so as to obtain information of a rotational movement of the trackball. The apparatus simulates a rolling of the dice according to the information of the rotation of the track ball, and the rolling of the dice is displayed on the CRT display. Information derived from a random number system may be added when the simulation is performed. The number indicated by the dice is finally displayed on the CRT display.

In the above-mentioned dice game machine, one of the players becomes a shooter, and the rolling of the dice somewhat depends on an operation for rotating the trackball. As a result, the number indicated by the dice, which is the result of the dice game, is dependent on the shooter's operation. That is, one of the players is involved in the determination process of the game. Accordingly, emotions of other players involved in the game are directed at the shooter. This adds fun to the dice game machine which fun is inherently involved in an actual dice game which is played by a plurality of players. Additionally, since one of the players is involved in the result determining process, the players tend to believe the game machine is fair, i.e., the players are treated equally by the game machine.

In the above-mentioned dice game machine, the rolling motion of the dice is simulated by a computer. Thus, the result of the game is displayed on the CRT display. However, the result determining process is unknown to the players. Accordingly, the players may still have an impression that the result of the game is controlled by the computer in the game machine. Thus, the game is not as enjoyable as a dice game using actual dice.

On the other hand, dice game machines using actual dice is known. In such dice game machines, dice are mechanically thrown onto a field, and players directly observe rolling of the dice and the final result indicated by the dice. In order to consecutively perform throwing of the dice, the dice game machine must have a dice throwing mechanism and a dice collecting mechanism to collect the dice from the field and return them to a launching station.

As the dice throwing mechanism, a mechanism used in a baseball pitching machine can be used in which pitching machine an object (ball) to be thrown is fed between two rollers which are rotated at a high speed. As an alternative, the dice are placed at a predetermined position and are shot by means of a reciprocation or a rotation of a mechanical member. Further, the dice may be blown out by ejection of air.

Japanese Laid-Open Patent Application No. 3-146082 discloses a dice game machine having a dice throwing mechanism using a plunger. In this dice throwing mechanism, the dice are conveyed to a predetermined position where the plunger is located. The dice are thrown by a reciprocation of the plunger in a predetermined direction. Additionally, the dice game machine uses a conveyor belt as a dice collecting mechanism which collects the dice thrown onto a field. That is, in this game machine, the field itself is a conveyer belt. The conveyer belt is moved after the dice are thrown to the field to convey the dice to the predetermined position. When the dice reach a predetermined position, the dice fall on another conveyor belt which conveys the dice to the position where the plunger is located. The conveying system of this dice game machine is complicated, and thus frequent maintenance operations are needed, which decreases a reliability of the game machine.

In this dice game machine, the dice are thrown onto the field by the same throwing force each time. And the throwing force is determined by the dice game machine, and thus the force is always constant. That is, this game machine cannot control the throwing force of the dice. Accordingly, the player cannot directly affect the dice. Thus, the game is less enjoyable than an actual dice game.

When the dice throwing mechanism like the above-mentioned pitching machine is used, it is difficult to change the throwing force in a very short time because a rotational speed of the rollers cannot be changed so quickly. Additionally, there may be a problem in that dice are damaged or broken by a pressing force exerted by the rollers.

Japanese Laid-Open Patent Application No. 54-62033 discloses a game machine having a dice collecting mechanism using a rake member which moves parallel to a surface of a field. In this game machine, two dice are used. The rake member moves the dice in a predetermined direction. In this dice collecting mechanism, guiding plates are provided on the field so that the dice moved by the rake member are guided to a center of one of sides of the field. Since a number indicated on each of the dice is read at a top face of the dice, the dice are not allowed to be on top of each other. That is, the dice must be placed side by side. Thus, the field is divided into left and right areas by a transparent plate, and one of the dice is located in the left area and the other of the dice is located in the right area. This collecting mechanism is simple as compared to that disclosed in the Japanese Laid-Open Patent Application No. 3-146082. However, a configuration of the field is restricted and the field is divided into two areas. Thus, the dice game machine appears significantly different than a traditional dice game table. This goes against a trend in the recent game machine market in which a real feeling (a traditional game feeling) is preferred.

SUMMARY OF THE INVENTION

It is a general object of the present invention to provide an improved and useful game apparatus in which the above-mentioned problems are eliminated.

A more specific object of the present invention is to provide a game apparatus which offers a game played by a plurality of players, the result of the game being dependent on an operation of one of the players, and a determination process being observed by each of the players.

Another object of the present invention is to provide a throwing mechanism used for a game apparatus which throwing mechanism throws an object toward a field defined by the game apparatus and quickly adjusts a throwing force in response to an operational force applied by a player.

Another object of the present invention is to provide a collecting mechanism used for a game apparatus which collecting mechanism is simple in construction and moves an object used in the game apparatus always to the same position.

Another object of the present invention is to provide a collecting mechanism used for a game apparatus using two objects which collecting mechanism collects the objects on a field of the game apparatus always in the same positional relationship.

In order to achieve the above-mentioned objects, there is provided according to one aspect of the present invention a game apparatus capable of performing a game played with a plurality of players, the game apparatus comprising:

at least one operation means for generating magnitude information indicative of a magnitude determined by one of the players, the operation means being manually operated by the one of the players so that the magnitude indicated by the magnitude information is arbitrarily varied by the one of the players;

detecting means for detecting the magnitude information generated by the operation means;

at least one object having means for determining a result of the game, the result of the game being dependent on a movement of the object, a moving process of the object being observed by the players; and driving means for applying a driving force to the object so that the object is moved, a magnitude of the driving force being controlled in accordance with the magnitude information detected by the detecting means.

In one embodiment of the present invention, the operation means comprises a shooting button which presses a piezoelectric element when the shooting button is hit by one of the player. The piezoelectric element outputs a voltage signal with a voltage level corresponding to the magnitude of the hitting force applied to the shooting button by one of the players. Additionally, the driving means includes an electromagnetic powder clutch which transmits a rotational force to the throwing plate. The electromagnetic powder clutch can control magnitude of the rotational force according to a current supplied thereto which current is varied in accordance with the voltage signal.

Additionally, there is provided according to another aspect of the present invention a throwing mechanism for throwing at least one object used for a game apparatus, the object having means for determining a result of a game which result is dependent on a movement of the object on a field, a moving process of the object being observed by players of the game, the throwing mechanism comprising;

an input unit which generates a signal varying in response to an operation applied to the input unit by one of the players;

a throwing member which throws the object toward the field by a pivoting motion;

a motor which rotates at a constant rotational speed;

an electromagnetic clutch provided between the motor and the throwing member for transmitting a rotational force from the motor to the throwing member; and current supplying means for supplying a current to the electromagnetic clutch, an intensity of the current being varied in accordance with the signal generated by the input unit.

Additionally, there is provided according to another aspect of the present invention a collecting mechanism for collecting at least one object used for a game apparatus, the object being thrown toward a field defined by the game apparatus and being at an arbitrary position on the field, the object having means for determining a result of a game which result is dependent on a movement of the object on the field, a moving process of the object being observed by players of the game, the collecting mechanism comprising;

a collecting member moving over the field in a longitudinal direction of the field from a rear side to a front side so that the object on the field is moved toward the front side of the field by a movement of the collecting member, the collecting member having a length substantially equal to a width of the field, the object being thrown from a predetermined position at the front side of the field; and a pair of attracting members, provided at the front side of the field, moving perpendicular to the longitudinal direction in opposite directions to each other, the object being sandwiched between the attracting members and placed at the predetermined position of the front side of the field.

In one embodiment of the present invention, a slope is provided on the front side of the field so that the object moved to the front side slides down along the slope and is maintained at a bottom side of the slope. When the game apparatus uses two identical ones of the object, a protruding member is provided on the collecting member. The protruding member protrudes from a leading edge of the collecting member at a height greater than a height of the object so that one of the objects positioned on the other is dropped off. Additionally, an extending member is provided on the bottom side of the slope. The extending member is moved from one side of the slope to the other side of the slope so that one of the objects positioned on the other is dropped off by an end of the extending member.

Other objects, features and advantages of the present invention will become more apparent from the following detailed description when read in conjunction with the accompanying drawings.

DETAILED DESCRIPTION OF THE PREFERRED EMBODIMENTS

Figure 1A:
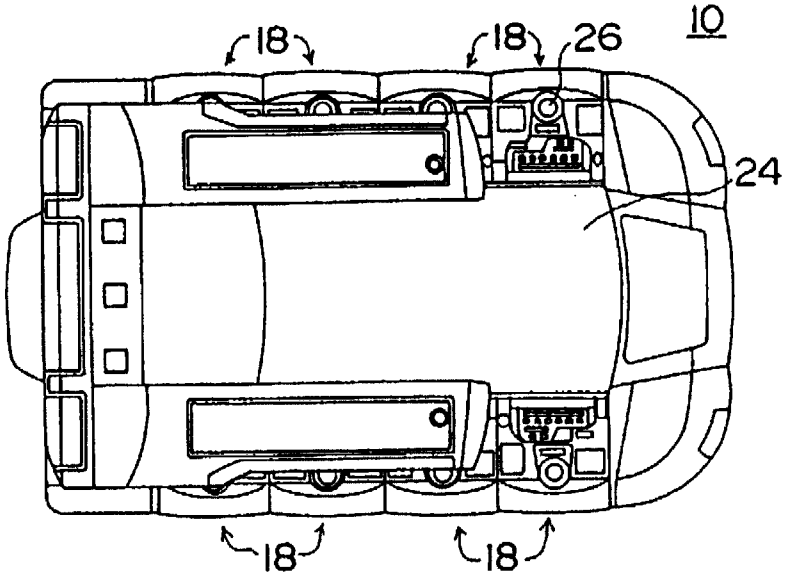
FIG. 1A is a plane view of a dice game machine according to an embodiment of the present invention.
Figure 1B:
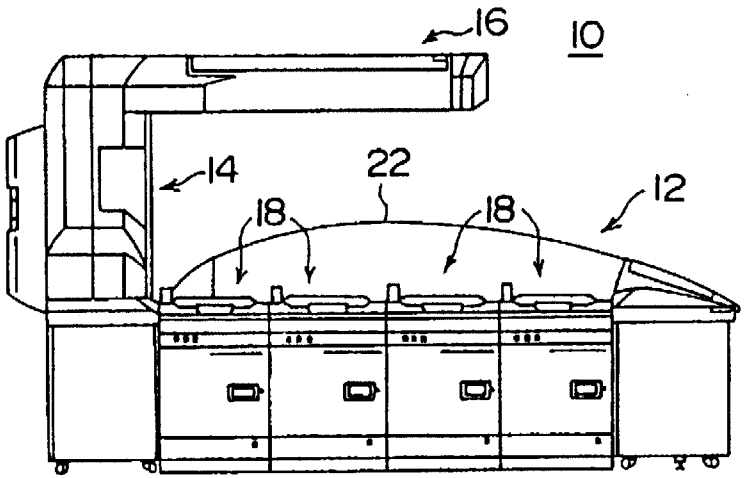
FIG. 1B is a side view of the dice game machine shown in FIG. 1A.
Figure 1C:
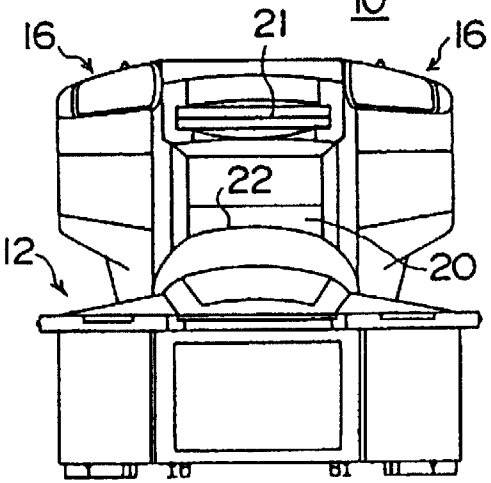
FIG. 1C is a front view of the dice game machine shown in FIG. 1A.

A description will now be given, with reference to FIGS. 1A, 1B and 1C, of an embodiment according to the present invention. FIG. 1A is a plane view of a dice game machine 10 according to the embodiment of the present invention; FIG. 1B is a side view of the dice game machine 10; FIG. 1C is a front view of the dice game machine 10.

The dice game machine 10 is a type of game machine which is installed in an amusement facility such as a game center. The dice game machine 10 comprises a main body 12, a screen unit 14 and an illumination unit 16. The screen unit 14 is raised from a rear part of the main body 12. The illumination unit 16 horizontally extends from the screen unit 14 over the main body 12. A total of eight satellites 18, four on the left side and four on the right side, are provided on the main body 12 so that a plurality of players (up to eight players) can jointly play a dice game. Each of the satellites 18 is provided with various switches and displays which are used to play the dice game. Each player faces the respective satellite 18 when playing the dice game. A display unit 20 is provided on the screen unit 14 so as to display information such as a progression of the game and rules of the game. Additionally, a dot display unit 21, which displays numbers indicated by dice, is provided on an upper part of the display unit 20. The illumination unit 16 extends from a top part of the screen unit 14 so as to illuminate the main body 18 and satellites 18 from above and to provide a decoration effect.

A center part of the main body 12, which is sandwiched between the left and right satellites 18 is covered by a transparent dome 22. A field 24 having a wide and flat area is provided inside the dome 22 so that the dice can be rolled. A green felt is applied on a surface of the field 24 which surface is observed through the transparent dome 22.

A description will now be given of an outline of the dice game played with the dice game machine 10. The dice game is played by a plurality of players. Each player guesses a number which will be indicated by two thrown dice. One of the players throws the dice by using a selected one of the satellites 18. The result for each player is determined by the number indicted by the thrown dice.

More specifically, each player stands in front of the respective satellite 18. When each player joins the dice game, guidance for playing the dice game is displayed on the display of the respective satellite 18. Each player then guesses a number to be indicated by the two dice and inputs the expectation information to the dice game machine 10 through operational switches provided on the respective satellite 18.

One of the satellites 18 through which tokens (coins) are input is selected by the dice game machine 10. One of the players is selected by this selection. This selection is performed based on, for example, a random number calculation method so as to maintain evenness or fairness of the game. By this selection, a shooting button 26 of the selected satellite 18 is lighted so as to invite the selected player to hit the shooting button 26. The shooting button 26 is provided with a lamp therein and is provided on each of the satellites 18. The selected player then hits the lighted shooting button 26 using his or her hand. The two dice are thrown toward the field 24 from a front side opposite to the screen unit 14 by the hitting operation. The throwing of the dice is performed by a dice throwing mechanism (not shown in FIGS. 1A, 1B and 1C) described later.

It should be noted that the throwing force applied to the dice is varied in accordance with a hitting force applied onto the shooting button 26. That is, if the shooting button 26 is hit strongly, the dice are thrown with a great force, and, on the contrary, if the shooting button 26 is hit weakly, the dice are thrown with a less power. Accordingly, the player can hit the shooting button 26 while hoping that his or her guessed number will be indicated by the dice after being thrown. In order to achieve the above-mentioned dice throwing mechanism, each of the shooting button 26s has a hitting forced detecting mechanism. The hitting force detecting mechanism comprises, for example, a piezoelectric element for converting the hitting force into an electric signal. A protrusion provided on a bottom side of the shooting button 26 presses the piezoelectric element when the shooting button 26 is hit by the player. A level of the electric signal output from the piezoelectric element is proportional to the strength of the hitting force applied to the shooting button 26.

Each of the two dice thrown toward the field 24 rolls on the field 24, and finally stops on the field 24. The number which is indicated on a top face of each the dice is hereinafter referred to as a resultant number. The roll of the dice on the field 24 can be observed by each player through the transparent doom 22. Accordingly, each player can directly observe and recognize the resultant number immediately after the dice are thrown.

The dice game machine 10 has a resultant number detecting system which electrically detecnumthe resultant number indicated by the dice on the field 24. The detection by of the resultant number detecting system can be performed as quickly as each player can recognize the resultant number. The resultant number detecting system may comprise the "dice number reading system" which is disclosed in Japanese Laid-Open Patent Application No. 5-177056 which was filed by the present applicant. This dice number reading system comprises a plurality of transponders (may be referred to as tags) and transmitting/receiving coils. Each of the transponders is embedded in a respective face of each of the dice so that one transponder corresponds to one face of each of the dice. The transmitting/receiving coils are provided under the top surface of the field 24. The transponders are provided with their own identification (ID) so that the number indicated by each of the dice can be recognized by detecting the ID of the transponder positioned closest to the transmitting/receiving coils. That is, when an electromagnetic wave is emitted toward the dice from the transmitting/receiving coils, each of the transponders embedded in the dice returns an electromagnetic wave having its own ID. The dice number reading system detects the ID of the transponder which is positioned closest to the transmitting/receiving coils. The detected ID represents the number indicated on a top face of the dice. That is, the resultant number is that indicated on a face opposite to a bottom face of which transponder is positioned closest to the transmitting/receiving coils. The electromagnetic wave signals assigned to the transponders are different from each other. Accordingly, the dice game machine 10, which uses two dice, requires 12 transponders so that one transponder corresponds to one of faces of the two dice.

Because the dice game machine 10 uses the abovementioned dice number reading system, a reliable and easy detection of the resultant number can be achieved as compared to a conventional reading system which uses an image processing system. Additionally, the resultant number reading system has an advantage in that the system can be constructed at a low cost.

As a detection system for the resultant number, methods have been suggested other than the above-mentioned dice number reading system. Japanese Laid-open Patent Applications No. 5-212158 and No. 5-212159 disclose a system using a video camera using a charge-coupled device (CCD) to take an image from above the dice. Japanese Laid-Open Patent Applications No. 1-198576 and No. 1-94879 also disclose a system in which a video camera is used to take an image from above the dice.

After the resultant number of the dice is detected, the dice game machine 10 compares the resultant number with the guessed number input by each user so as to determined the result of the game for each player. The dice game machine 10 then distributes corresponding points to each of winners. The players can put a weight on their guess so that the points are increased in accordance with the weight. This provides game variation which increases enjoyment of the game. Additionally, since the players use some kind of calculation ability, it is said that playing the game offered by the dice game machine 10 is effective to treat a person having senile dementia.

After one game is ended, the dice are collected from the field 24 by a dice collecting system (to be described later). The collected dice are supplied to the dice throwing mechanism to prepare for the next game. It should be noted that a time period spent on the collection of the dice is 25 to 30 seconds. The players input their guess during this time period. The shooter of the next game is sequentially selected in accordance with a predetermined order. However, the shooter may be selected by a method in which a player who won maximum points in a game has a right to become the shooter for the next game.

Figure 2A:
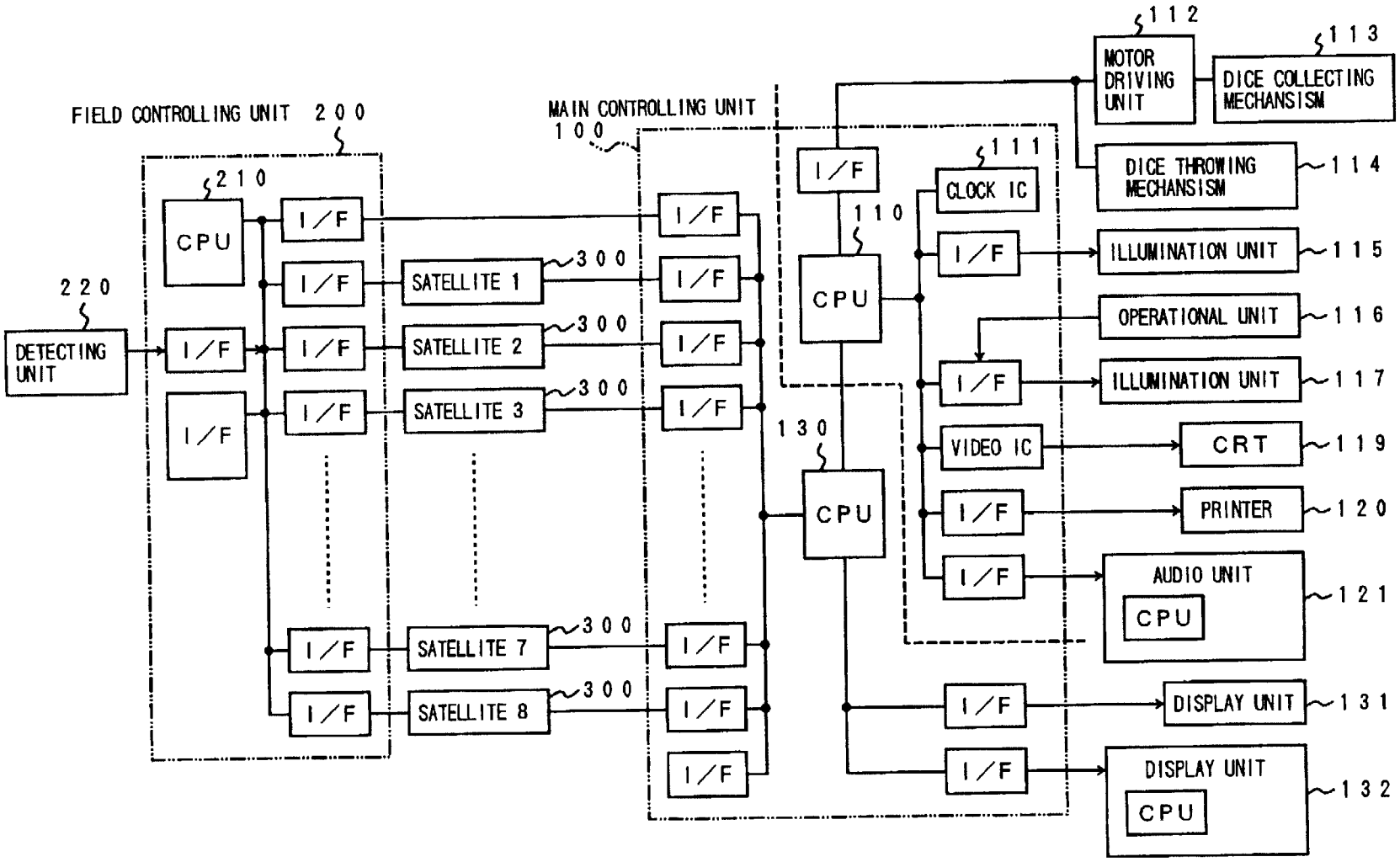
FIG. 2A is a block diagram of a main controlling unit and a field controlling unit provided in the dice game machine shown in FIG. A.
Figure 2B:
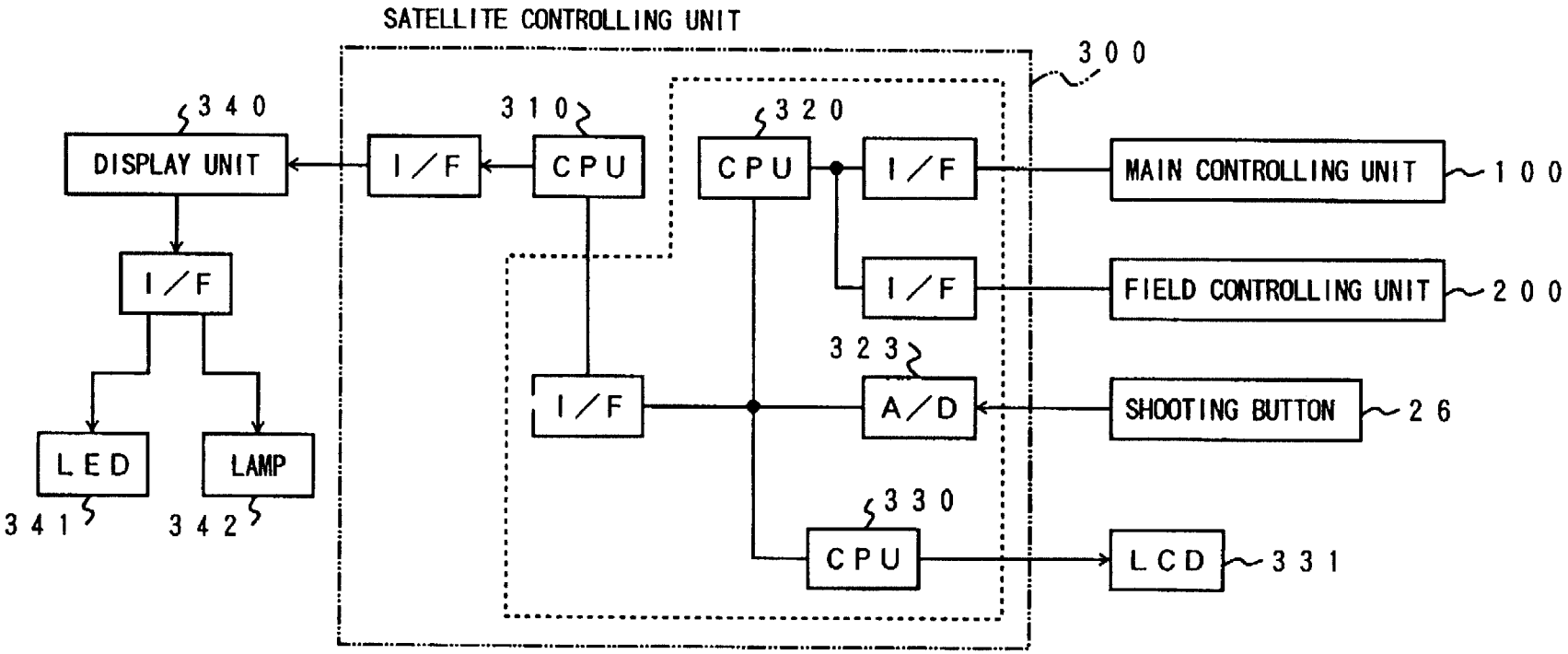
FIG. 2B is a block diagram of one of satellite controlling units shown in FIG. 2A.

A description will now be given, with reference to FIGS. 2A and 2B, of a controlling system of the dice game machine 10. FIG. 2A is a block diagram of a main controlling unit 100 and a field controlling unit 200. FIG. 2B is a block diagram of the one of satellite controlling units 300 shown in FIG. 2A.

In FIG. 2A, the controlling system of the dice game machine 10 is roughly divided into the main controlling unit 100, the field controlling unit 200 and the satellite controlling unit 300 provided for each of the eight satellites 18. These controlling units are provided on a main controlling circuit board, a field controlling circuit board and satellite controlling circuit boards, respectively.

The main controlling unit 100 comprises two main central processing units (CPUs) 110 and 130. The two CPUs 110 and 130 are connected to each other. The main CPU 130 is connected to a main controlling CPU 210 of the field controlling unit 200 via an optical communication unit which comprises an optical cable and communication controlling IC interfaces (I/Fs). The main CPU 130 is also connected to a CPU 320 provided in each of the satellite controlling units 300 via the respective optical communication units. Additionally, the main CPU 130 is connected to a display unit 131 and a display unit 132 via the respective input/output controlling IC interfaces (I/Fs).

The main CPU 110 is connected to a motor driving unit 112 and a dice throwing mechanism 114 via an input/output controlling IC I/F. The motor driving unit 112 is connected to a dice collecting mechanism 113. A clock IC is connected to the main CPU 110. Additionally, the CPU 110 is connected to illumination units 115 and 117 via respective input/output controlling IC I/Fs. An operational unit 116 is connected to the I/F between the illumination unit 117 and the CPU 110. Further, the main CPU 110 is connected to a cathode ray tube (CRT) via a video IC. The CPU 110 is also connected to a printer 120 and an audio unit via respective input/output controlling IC I/Fs. Each of the connections between each of the illumination units 115 and 117 and the display unit 132 and the corresponding input/output controlling IC I/Fs comprises an optical communication unit similar to that provided between the CPU 130 and the CPU 210.

The field controlling unit 200 comprises a CPU 210 which controls an entire function of the field controlling unit 200. The CPU 210 is connected to a sub CPU 320 of each of the satellite controlling units 300 via respective optical units similar to the above-mentioned optical unit. The CPU 210 is connected to a detection unit 220 via an input/output controlling IC I/F comprising an optical communication unit similar to the above-mentioned optical communication unit.

Each of the satellite controlling unit 300 comprises a main CPU 310 and two sub CPUs 320 and 330. The main CPU 310 and the sub CPUs 320 and 330 together control an entire function of the satellite controlling unit 300. The sub CPUs 320 and 330 are connected to each other and are connected to the main CPU 310 via an input/output controlling IC I/F. The sub CPU 320 is also connected to the shooting button 26 via an analog to digital (A/D) converter 323. The sub CPU 330 is connected a liquid crystal display (LCD) 331. Additionally, the main CPU 310 is connected to a display unit 340 via an optical communication unit similar to the above-mentioned optical communication unit. The display unit 340 is further connected to a light emitting diode (LED) 341 and a lamp 342 via an input/output controlling IC I/F.

As mentioned above, the present controlling system uses optical communication units at various connections so as to achieve a high-speed signal transmission.

Figure 3:
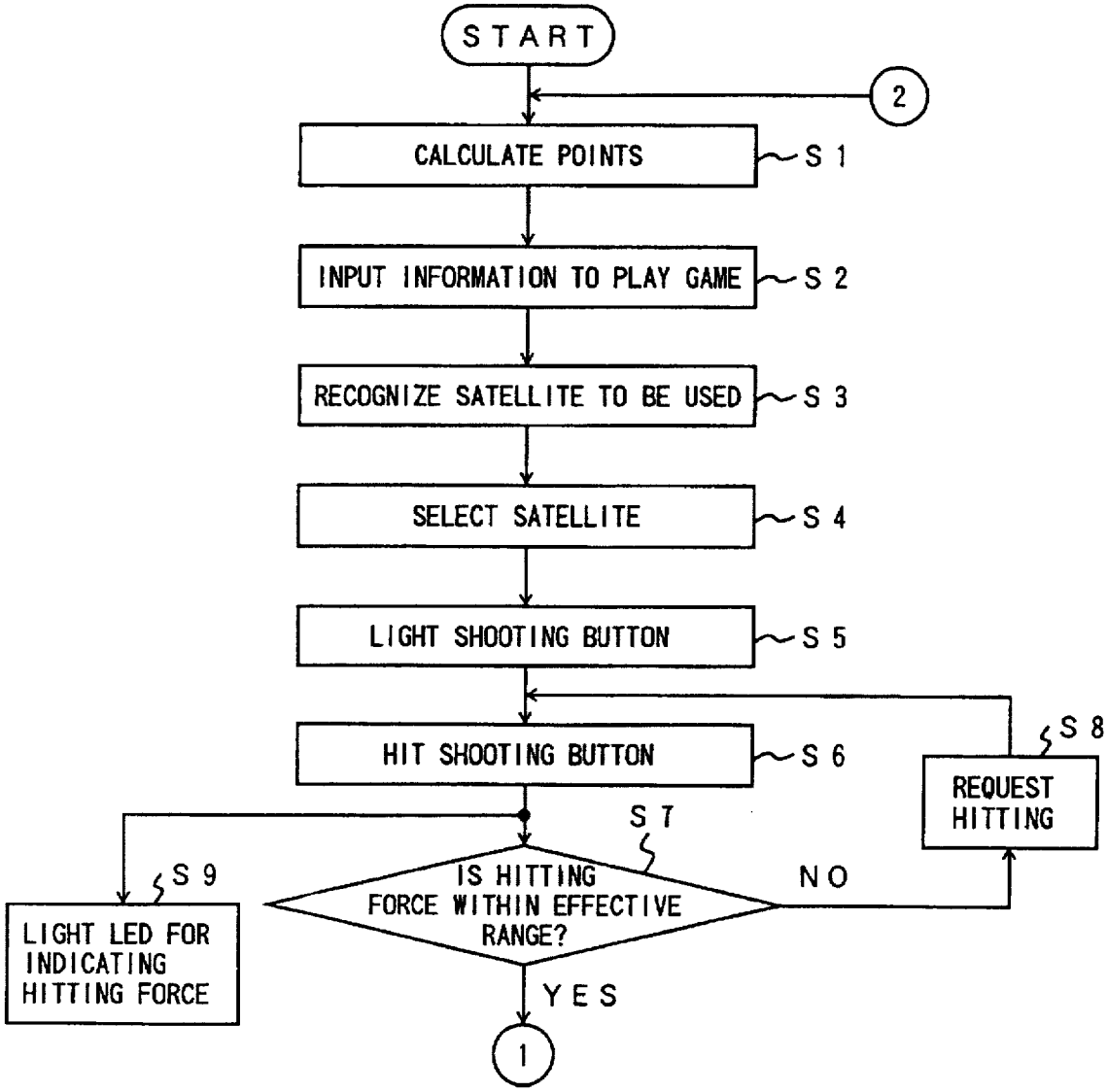
FIG. 3 is a part of a flowchart for explaining a main operation of the dice game machine shown in FIG. 1A.
Figure 4:
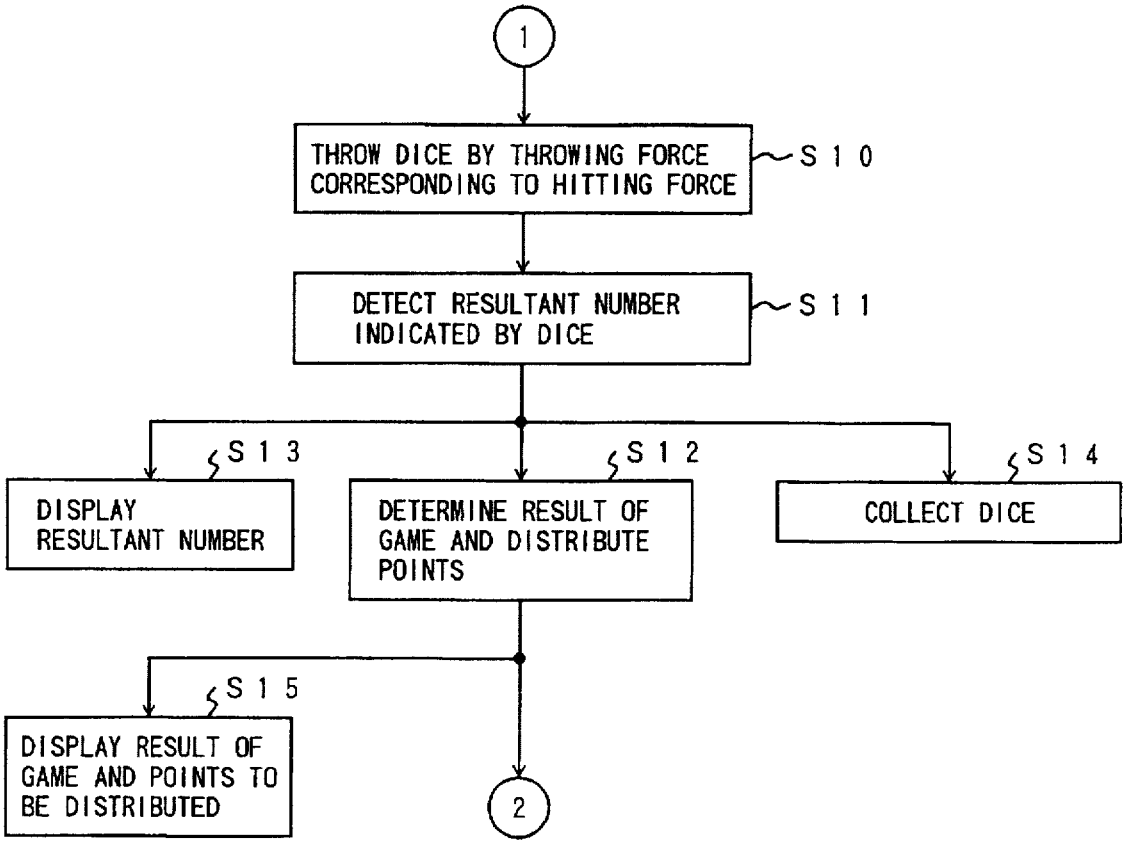
FIG. 4 is a part of the flowchart for explaining a main operation of the dice game machine shown in FIG. 1A.

A description will now be given, with reference to FIGS. 3 and 4, of an operation of the above-mentioned controlling system. FIGS. 3 and 4 are parts of a flowchart for explaining a main operation of the dice game machine 10.

It should be noted that the main CPU 130 of the main controlling unit 100 displays on the display unit 20 shown in FIG. 1A general information including progression and rules of the game, any time if it is necessary, by using the display unit 132 which itself has a CPU having an image controlling function. Additionally, the CPU 110 controls the illumination units 115 and 117 to light illumination lamps provided in the illumination unit 16 shown in FIG. 1A in accordance with a predetermined program. The CPU 110 also controls the audio unit 121 to output various sounds and music in accordance with a musical instrument digital interface (MIDI). By the illumination and the sounds, the dice game machine 10 excites the players and attracts people in an area around the dice game machine 10. It should be noted that the operational unit 116, the CRT 119 and the printer 120 in the main controlling unit 100 are provided for mainly a maintenance purpose, for example, for checking a condition of the dice game machine 10.

Referring to FIG. 3, the CPU 310 of each of the satellites 18 calculates, in step 1 (hereinafter step is abbreviated as S), the present points of each player. Then, each player inputs, in S2, information representing that the player intends to play a next game through the respective satellite 18. The information is detected by the satellite controlling unit 300, and the information is transferred to the main CPU 130 of the main controlling unit 100 via the sub CPU 320. The CPU 130 recognizes, in S3, the satellites 18 which are currently being used by the players. A number indicating device is provided on the display unit 340 of each of the satellites 18 so as to indicate the present points of the player and the points set for the next game. The setting of the points for the next game can be performed as follows.

The sub CPU 320, which detects the information representing that the corresponding player intends to play the next game, controls the sub CPU 330 to display on the LCD 331 guidance instructing the player to set the points. When the player inputs the points by using a setting button provided on the corresponding satellite 18, the point information is sent to the main CPU 310. The main CPU 310 displays the point information on the number indicating device of the display unit 340.

The CPU 330 displays on the LCD 331 information on the progress of the game to inform each player of the current stage of the game. The CPU 130 of the main controlling unit 100 then selects the shooter, in S4, in accordance with a predetermined program. The CPU 130 sends corresponding information to the satellite controlling unit 300 of the selected satellite 18. The sub CPU 320 of the selected satellite 18 sends, in $5, information to the shooting button 26 to light the lamp 342 which is provided in the shooting button 26. Then the shooter (the player of the corresponding satellite 18) hits the shooting button 26 in S6. The hitting force exerted on the shooting button 26 is converted into an electric signal by the aforementioned hitting force detecting mechanism. The electric signal is supplied to the A/D converter so that an analog electric signal is converted into a digital signal which represents an intensity of the electric signal. The digital signal is then supplied to the main CPU 310. The main CPU 310 lights, in S9, a corresponding number of a plurality of LEDs 341 (shown in FIG. 5) provided around the shooting button 26 via the display unit 340 in accordance with the digital signal, the number being in proportion to the hitting force exerted on the shooting button 26. This lighting operation of the LEDs 341 is limited to the selected satellite 18. Accordingly, if one of the players other than the shooter hits the shooting button 26 on a non-selected satellite 18, the LEDs 341 around the shooting button 26 on the non-selected satellite 18 do not light.

The LEDs 341 are lighted almost at the same time the corresponding shooting button or shooting control member 26 is hit. Accordingly, the player can visually recognize the hitting force applied to the shooting button 26. This makes the game more enjoyable for the players.

When a magnitude of the hitting force falls, in S7, within a predetermined effective range, the throwing force applied to the dice is varied correspondingly to the hitting force. If the hitting force exceeds a maximum magnitude of the predetermined effective range, the throwing force of the dice is maintained at a predetermined maximum throwing force so as to limit a power applied to the dice. This is to prevent damage to the dice, and also to prevent the shooting button 26 from being hit by an excessive hitting force. On the other hand, if the hitting force does not reach a predetermined minimum magnitude of the effective range, the dice are not thrown by the dice throwing mechanism. This is to prevent an undesired controlled throwing of the dice. That is, if the dice are thrown by a very small throwing force, the dice may be thrown with only a few rolls. This may allow the shooter to control the resultant number indicated by the dice. If the resultant number of the dice is controlled by the shooter, the enjoyment of the game is decreased.

In order to provide the players a feel as to the magnitude of the hitting force, the number of the LEDs 341 to be lighted is determined as follows. That is, when the hitting force does not reach the minimum magnitude of the effective range, no LED 341 is lighted. When the hitting force corresponding to the minimum magnitude of the effective range is applied onto the shooting button 26, only one LED 341 is lighted. On the other hand, when the hitting force corresponds to the maximum magnitude of the effective range, all of the LEDs 341 are lighted. Accordingly, the players can learn visually the effective range of the hitting force, and thus the players can control a magnitude of the hitting force applied onto the shooting button 26 within the predetermined effective range.

Figure 5:
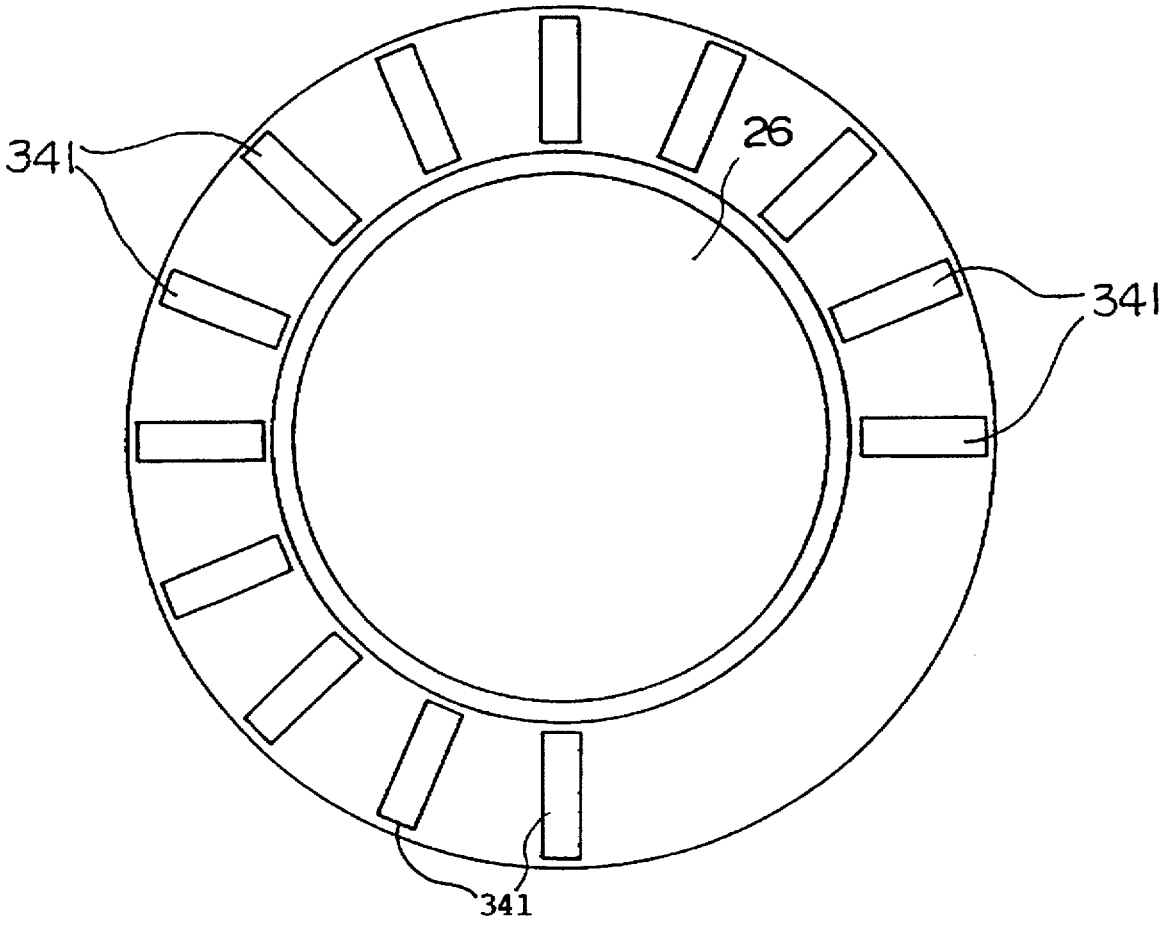
FIG. 5 is a plan view of a shooting button surrounded by a plurality of LEDs.

It should be noted that the LEDs 341 shown in FIG. 5 are used as illumination when no game is performed by the dice game machine 10. In this condition, the main CPU 310 controls the lighting of the LEDs 341.

The program for controlling the dice throwing mechanism includes the following procedures. When the hitting force applied to the shooting button 26 does not reach the minimum magnitude of the predetermined effective range in S7, guidance which requests the shooter to hit the shooting button 26 again using more power is displayed, in S8, on the LCD 331 of the satellite 18. Additionally, when no hitting force is applied to the shooting button 26 for a predetermined time period, the dice game machine 10 automatically throws the dice toward the field 24 so as to eliminate an undesired delay of the game.

When the shooter hits the shooting button 26, a signal including information regarding a magnitude of the hitting force is sent to the CPU 130 of the main controlling unit 100 via the sub CPU 320 after the signal is converted into a digital signal by the A/D converter 323. The information regarding the magnitude is then sent to the main CPU 110, and the main CPU 110 controls the dice throwing mechanism 114 to throw the dice with a power corresponding to the magnitude of the hitting force. As a result, the dice throwing mechanism 114 throws, in S10, the dice toward the field 24 with the corresponding force.

The dice thrown by the dice throwing mechanism 114 fly above the field 24 and hit a wall provided on an opposite side of the field 24. The dice then fall on the field 24 and stop after rolling. It should be noted that when the hitting force applied to the shooting button 26 is not sufficient, the dice fall on the field 24 before they hit the wall.

When the shooter hits the shooting button 26, information representing that the shooting button 26 has been hit is sent to the CPU 210 of the field controlling unit 200 from the corresponding satellite 18. The CPU 210 which receives the information operates the detection unit 220. The detection unit 200 detects, in Sll, the resultant number of each of the dice on the field 24. The information regarding the resultant number is sent to the main CPU 130 of the main controlling unit 100 via the CPU 210 off the field controlling unit 200. The information is then sent to the display unit 131 which includes the dot indicating unit 21 shown in FIG. 1C. Thus, the resultant numbers indicated by the dice are displayed, in S13, on the dot indicating unit 21. Additionally, the CPUs 110 and 130 determine the result of the game for each satellite 18 (each player), and then the points are distributed, in S12, to the satellites 18 in accordance with the result. The result of the game and the points to be distributed to the satellites 18 are displayed on the display unit 20.

On the other hand, when the detection of the resultant number performed by the detection unit 220 is completed, the CPU 210 sends corresponding information to the main CPU 110 of the main controlling unit 100. The main CPU 110 operates the dice collecting mechanism 113, in S14, to collect the two dice on the field 24 so that the dice are returned to a predetermined position in the dice throwing mechanism 114. The main CPU 110 controls the display unit 132 to display the guidance of the game on the display unit 20 shown in FIG. 1C. Additionally, the CPU 110 controls the CPUs 320, 330 of each of the satellites 18 to display the guidance of the game on the LCD 331. The operation of the dice game machine 10 returns to the step 1 to repeat the above-mentioned procedures so as to perform a next game.

It should be noted that the number of CPUs and the function assigned to each of the CPUs are not limited to the above-mentioned structure. However, it is necessary to determine the configuration of the CPUs so that a smooth progression of the game is not prevented due to a long processing time for performing each of the above-mentioned steps and a long data transmission time between the CPUs and between each unit and the CPUs.

A description will now be given of the dice throwing mechanism 114 and the dice collecting mechanism 113.

Figure 6:
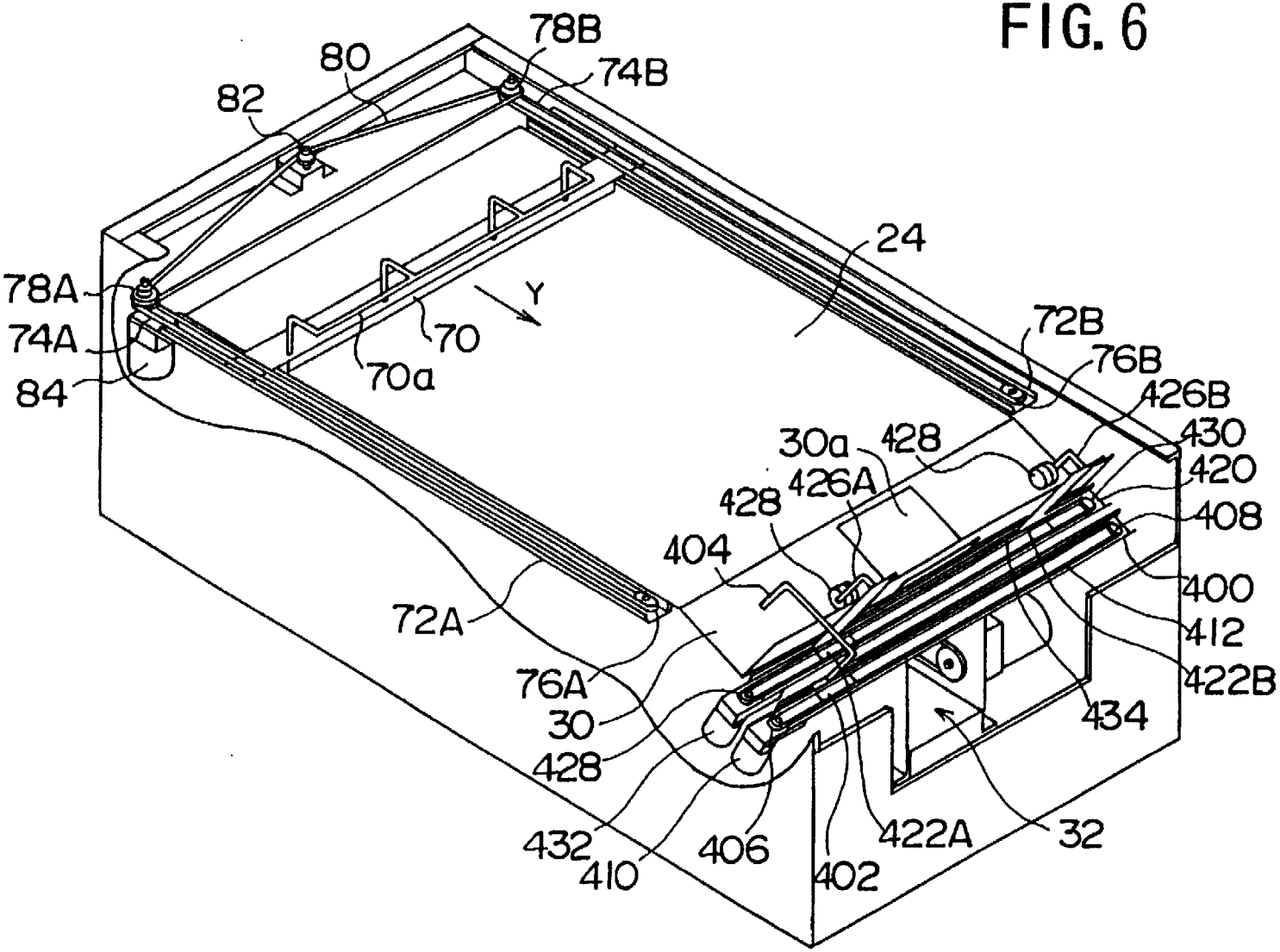
FIG. 6 is a perspective view of an interior of the main body 12 of the dice game machine shown in FIG. 1A.

FIG. 6 is a perspective view of the inside of the main body 12 of the dice game machine 10 shown in FIGS. 1A, 1B and 1C. The dice throwing mechanism 114 and the dice collecting mechanism 113 are provided around the field 24 inside the main body 12. A front side of the field 24 is connected to a slope 30. The dice on the field 24 are moved to the slope 30 by the dice collecting mechanism 113. The dice slide along the slope 30 and are collected in the center of the bottom side of the slope 30 where a throwing plate of the dice throwing mechanism 114 is positioned. Thus, the dice are placed on the throwing plate. It should be noted that the dice throwing mechanism 114 is provided in a space 32 shown in FIG. 6.

Figure 7:
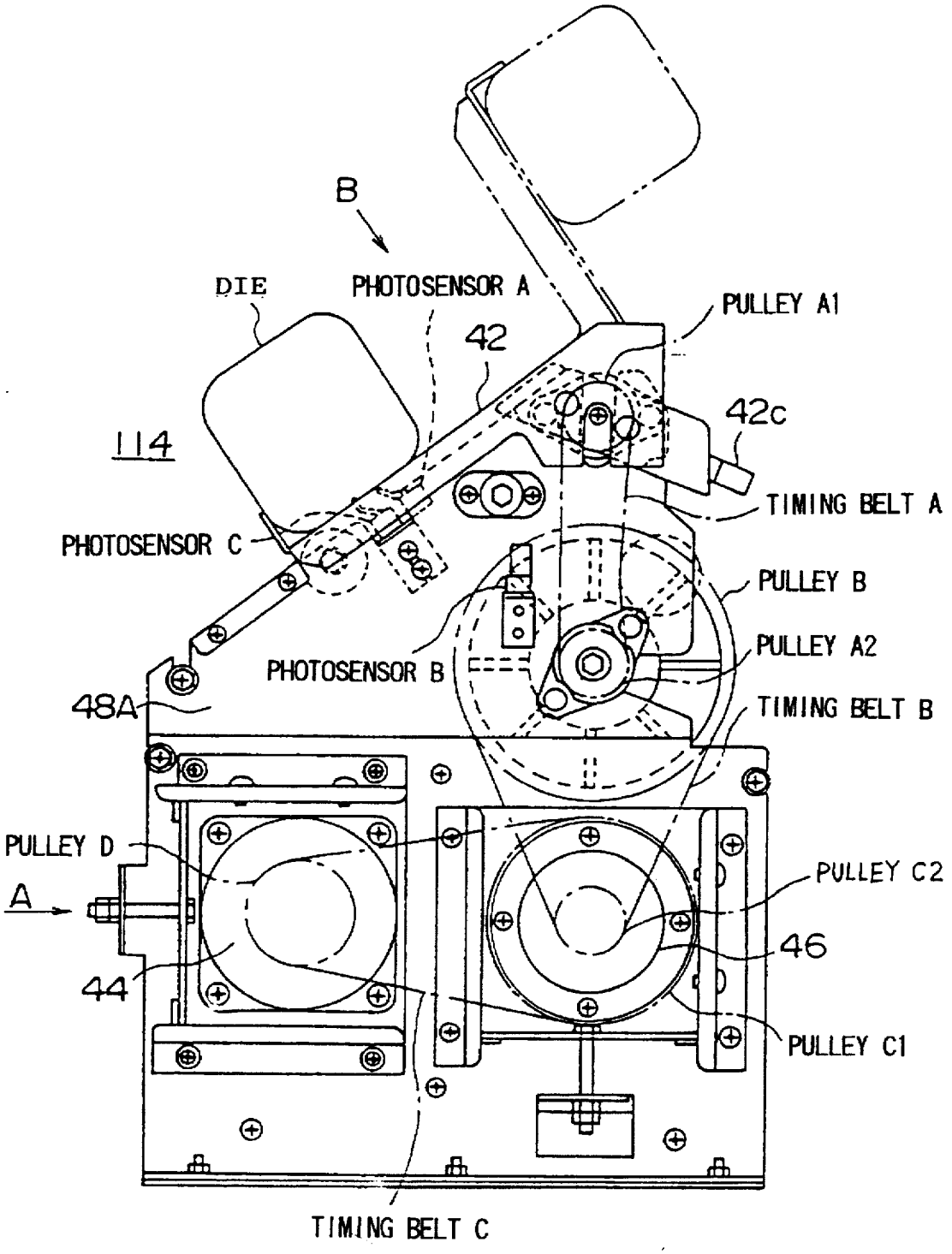
FIG. 7 is a side view of a dice throwing mechanism provided in the dice game machine shown in FIG. 1A.
Figure 8:
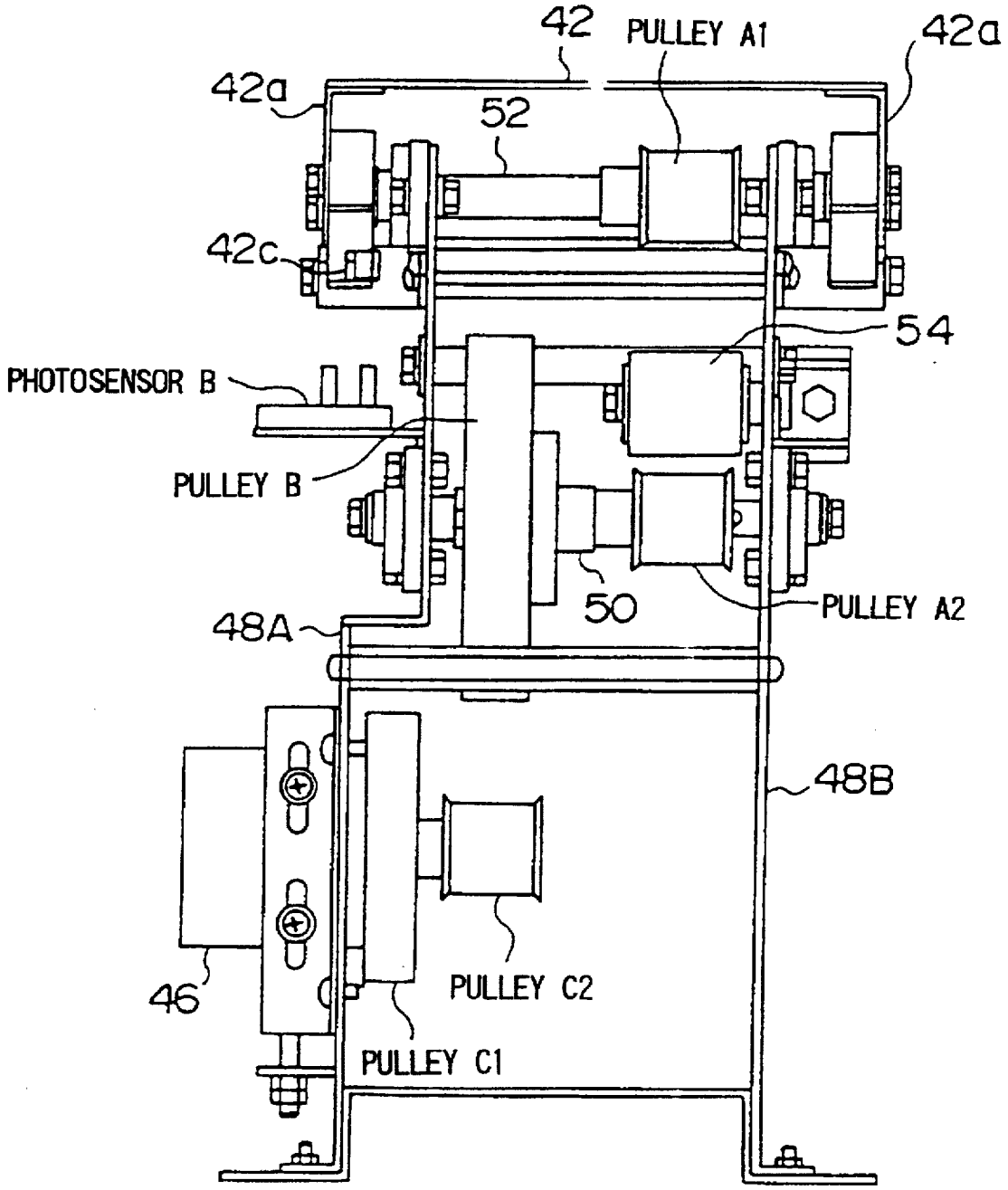
FIG. 8 is a front view of the dice throwing mechanism shown in FIG. 7.

FIG. 7 is a side view of the dice throwing mechanism 114. FIG. 8 is a front view of the dice throwing mechanism 114. The dice throwing mechanism 114 is constituted as a single unit so that an entire mechanism is removed from the main body of the dice game machine 10. Accordingly, a maintenance and repair of the dice throwing mechanism 114 is easy.

The dice throwing mechanism 114 comprises the above-mentioned throwing plate 42, a driving AC motor 44, and an electromagnetic powder clutch 46. The electromagnetic powder clutch 46 controls transmission of a driving force of the driving AC motor 44. These parts are connected by pulleys and timing belts.

Figure 9:
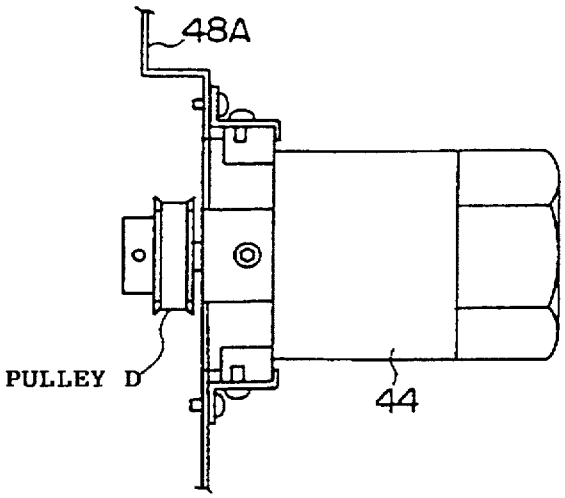
FIG. 9 is a side view of a driving AC motor provided in the dice throwing mechanism shown in FIG. 7.

The AC motor 44 and the electromagnetic powder clutch 46 are mounted on a side plate 48A. As shown in FIG. 9, a pulley D is mounted on a shaft of the AC motor 44. A pulley C1 is mounted on a power input side of the electromagnetic powder clutch 46, and a pulley C2 is mounted on a power output side of the electromagnetic powder clutch 46. The pulley D of the AC motor 44 is coupled to the pulley C1 of the electromagnetic powder clutch 46 by a timing belt C.

A shaft 50 is provided above the electromagnetic powder clutch 46. The shaft 50 is rotatably supported by the side plate 48A and a side plate 48B. Pulleys B and A2 are mounted on the shaft 50. The pulley B is positioned directly above the pulley C2 mounted on the power output side of the electromagnetic powder clutch 46. The pulley B and the pulley C2 are coupled by a timing belt B. A diameter of the pulley B is greater than a diameter of the pulley C2 so that a predetermined reduction ratio is obtained. A tension of the timing belt C is adjusted by slightly moving a position of the AC motor 44 or the electromagnetic powder clutch 46.

A shaft 52 is provided directly above the shaft 50. Similarly to the shaft 50, the shaft 52 is rotatably supported by the side plates 48A and 48B. A pulley A1 is mounted on the shaft 52 directly above the pulley A2. The pulley A1 and the pulley A2 are coupled by a timing belt A. A tension of the timing belt A is adjusted by only an idle roller 54 provided between the pulley A1 and the pulley A2. The idle roller 54 is rotatably mounted on the side plate 48B so that the idle roller 54 presses a portion of an outer surface of the timing belt A. Accordingly, an adjusting mechanism such as an idle pulley for adjusting the tension of the timing belt A is not needed in the dice throwing mechanism 114. Thus, an assembling process of the dice throwing mechanism 114 is simple and the number of parts is reduced.

Opposite ends of the shaft 52 are extended from the respective side plates 48A and 48B. Angle portions 42*a* of the throwing plate 42 are mounted on the opposite ends of the shaft 52, respectively. The throwing plate 42 is normally positioned at a home position shown in solid lines in FIG. 7. A photosensor A detects that the throwing plate 42 is in this position. The photosensor A has a rotatable lever (not shown in the figures) which rotates by being pressed by a portion of the throwing plate 42. When the rotatable lever is rotated by the throwing plate 42, the rotatable lever interrupts an optical path of the photosensor A, and thus a signal is output from the photosensor A. The photosensor A is provided under the throwing plate 42 as shown in FIG. 7.

Figure 10:
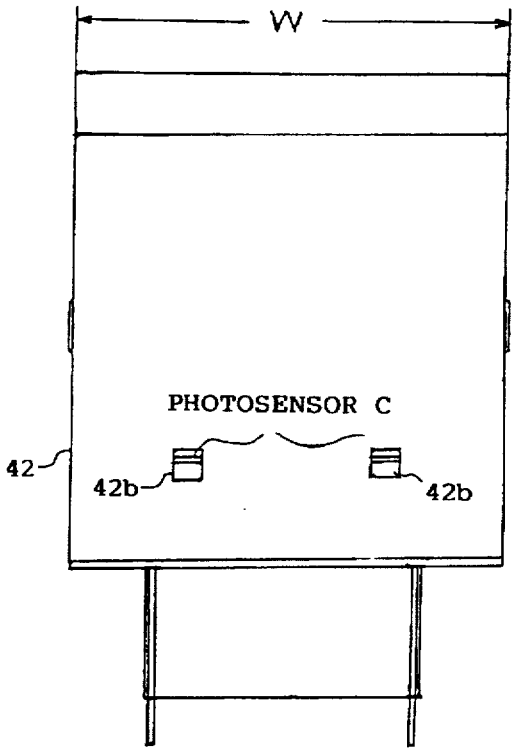
FIG. 10 is a view of a throwing plate viewed from a direction indicated by an arrow B of FIG. 7.

FIG. 10 is a view of the throwing plate 42 viewed from an arrow indicated by B in FIG. 7. As shown in FIG. 10, a width W of the throwing plate 42 is twice a width of one of the dice, and thus the two dice are thrown at the same time. Two openings 42*b* are provided in the throwing plate 42. A photosensor C is provided under each of the openings 42*b*. The photosensor C has the same structure as that of the photosensor A. When the throwing plate 42 is at the home position as shown in solid lines in FIG. 7, an end of a rotatable lever of each of the photosensors C protrudes from the respective opening 42*b*. Accordingly, when dice are placed on the throwing plate 42, the rotatable lever of each of the photosensors C is pressed by the corresponding dice. Thereby, a presence of the two dice on the throwing plate 42 is detected by the photo sensors C.

An extending portion 42*c* is provided on one of the angle portions 42*a* of the throwing plate. The extending portion 4 2*c* is mounted so that an end thereof projects into a slit of a photosensor B, which comprises a photointerrupter and is mounted on the side plate 48A, when the throwing plate 42 reaches an end position which is an end of a rotation of the throwing plate 42. Accordingly, the photosensor B can detect a completion of throwing of the dice.

In the above-mentioned throwing mechanism 114, a pulley with teeth is used for each of the pulleys A1, A2, B, C and D. And each of the timing belts A, B and C comprises a timing belt having a waved inner surface. Since the waves of the timing belts engage with the teeth of the pulleys, there is no problem due to a backlash when gears are used for transmitting a rotational force. Thus, the dice throwing mechanism 114 has a good response with respect to transmission of the rotational force.

It should be noted that since two dice are used in the dice game machine 10, two photosensors C are provided. The number of photosensors C must correspond to the number of dice used in the dice game machine. Additionally, although photosensors are used in the dice throwing mechanism 114, micro limit switches may be used instead.

As mentioned above, the dice throwing mechanism 114 is accommodated in the space 32 shown in FIG. 6. When the dice throwing mechanism 114, the throwing plate 42 of which is at the home position, is accommodated in the space 32, the throwing plate 42 corresponds to an opening 30*a* of the slope 32 shown in FIG. 6. Accordingly, the dice slide along the slope 32 and are placed on the throwing plate 42.

Figure 11:
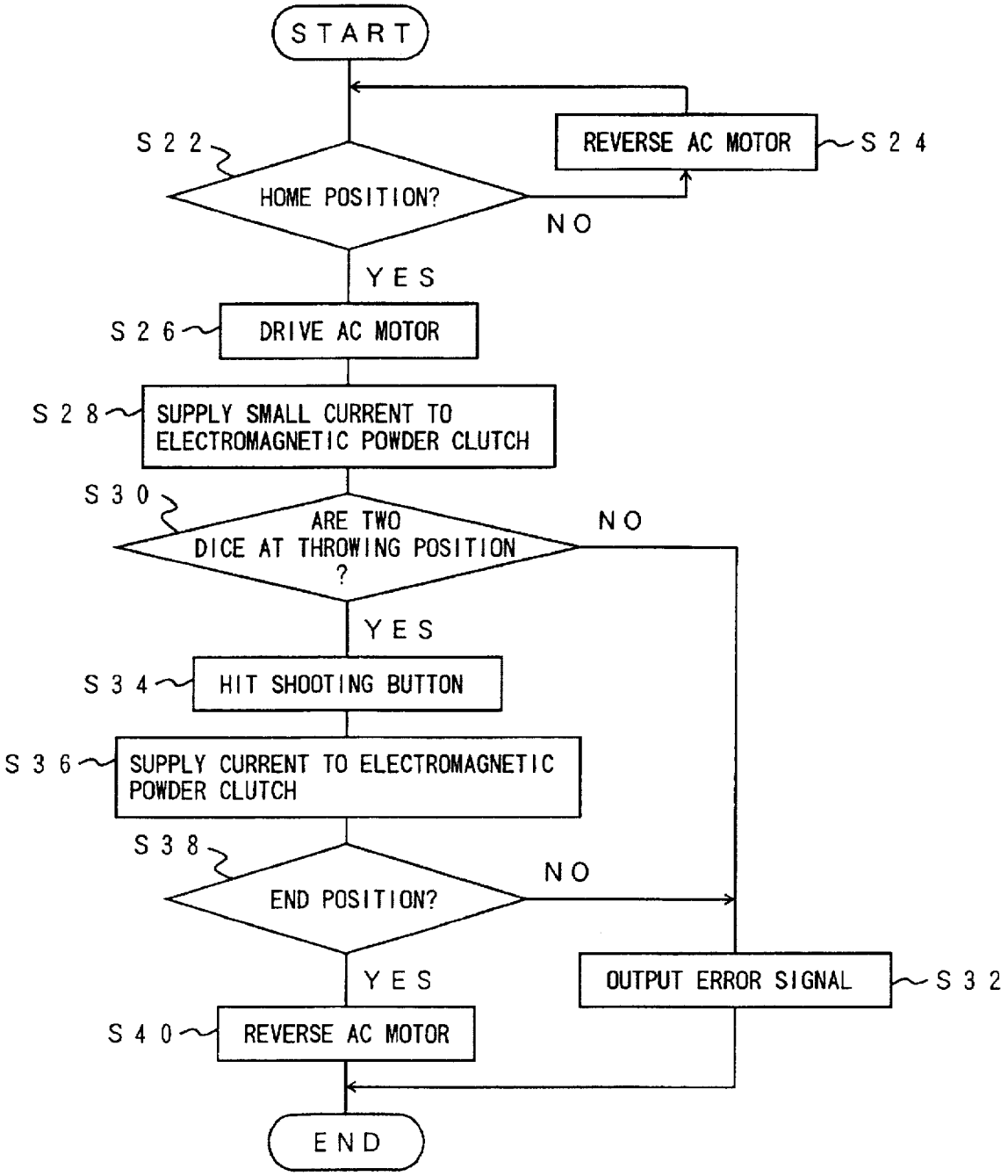
FIG. 11 is a flowchart of an operation performed by the dice throwing mechanism shown in FIG. 7.

A description will now be given, with reference to FIG. 11, of an operation of the dice throwing mechanism 114. FIG. 11 is a flowchart of an operation of the dice throwing mechanism 114.

It is assumed that the two dice are placed on the throwing plate 42 by the dice collecting mechanism 113. While the dice are collected, each player who intends to play the next game guesses the resultant number and sets the points through the corresponding satellite 18. Additionally, as previously mentioned, one of the satellites 18 is selected to determine the shooter for the next game.

When one of the satellites 18 is selected, it is determined, in S22, whether the throwing plate 42 is at the home position. If the throwing plate 42 is not at the home position, the AC motor 44 is reversed, in S24, to return the throwing plate 42 to the home position. The routine then return to S22.

If it is determined, in S22, that the throwing plate 42 is at the home position, the AC motor 44 is rotated, in S26, at a predetermined constant rotational speed in a normal direction. At this time, a small current is supplied, in S28, to the electromagnetic powder clutch 46. However, the small current is not sufficient for activating the electromagnetic powder clutch 46. Accordingly, in this state, the pulley Cl of the power input side of the electromagnetic powder switch 46 is rotated by the timing belt C while the pulley C2 of the power output side of the electromagnetic powder clutch 46 is not rotated. That is, the rotational force of the AC motor 44 is not transmitted to the pulley C2 of the electromagnetic powder clutch 46.

After the rotational speed of the AC motor has reached the predetermined constant rotational speed, it is determined, in S30, whether or not the two dice are correctly positioned on the throwing plate 42. If it is determined that at least one of the dice is not positioned on the throwing plate 42, an error signal is generated, in S32, so as to stop the throwing operation. When it is determined that the dice are positioned on the throwing plate 42, a notification is made to the shooter. Thus, the shooter of the selected satellite 18 hits the shooting button 26 in S34.

Figure 12:
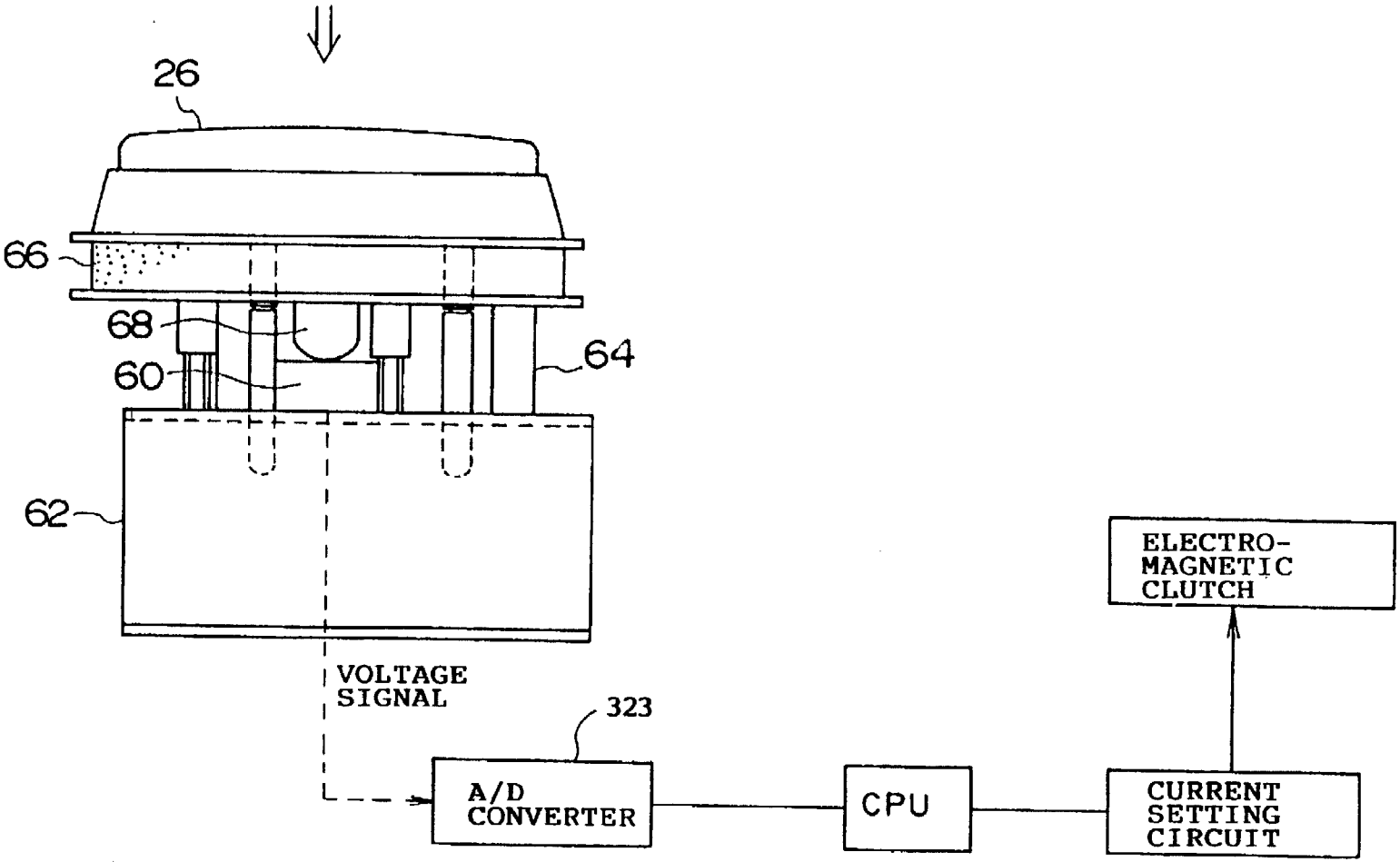
FIG. 12 is a side view of a shooting button and a supporting mechanism provided in the dice game machine according to the present invention.

The shooting button 26 is connected to a voltage signal generating unit 60 as shown in FIG. 12. The voltage signal generating unit 60 comprises a piezoelectric element which generates a voltage a magnitude of which corresponds to the magnitude of the hitting force applied onto the shooting button 26. The shooting button 26 is supported by a bracket 64 protruding from a bracket 62. Since the shooting button 26 is hit by the shooter, a rubber cushion is provided on a bottom side of the shooting button 26. A pressing member 68 is provided on the bottom of the shooting button 26. When the pressing button 26 is hit by the shooter, the hitting force is applied to the voltage signal generating unit 60, and the voltage signal corresponding to the hitting force is output from the voltage signal generating unit 60. The voltage signal is converted into a digital signal having 128 levels by the A/D converter 323 (refer to FIG. 2A). The CPUs in the dice game machine 10 control a current setting circuit as current supplying means so that a predetermined current is supplied, in S36, to the electromagnetic powder clutch 46. The analog to digital conversion and the supply of the current to the electromagnetic powder clutch 46 are achieved by known circuitry, and thus descriptions thereof will be omitted.

Figure 13:
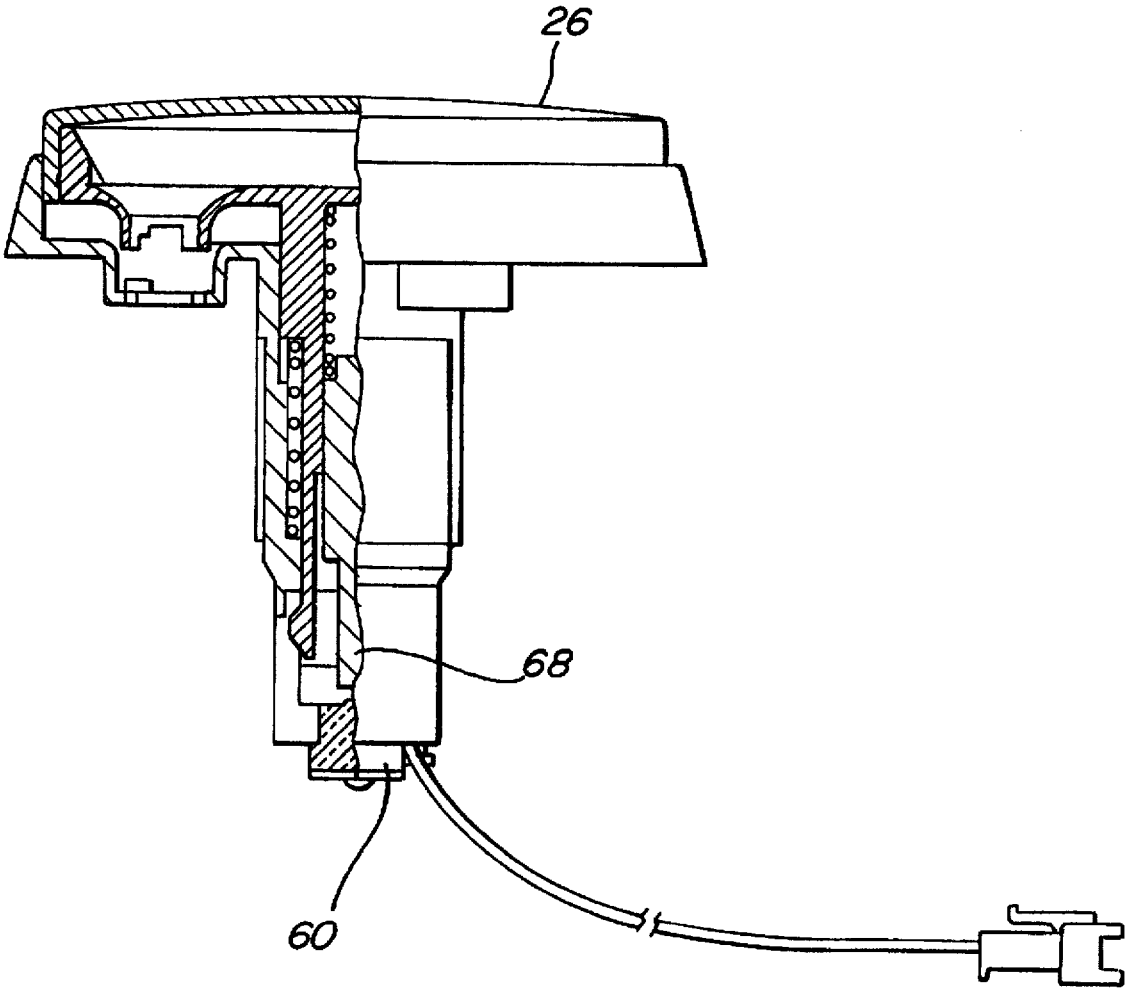
FIG. 13 is a side view of another example of the shooting button.

FIG. 13 is a side view of another example of the shooting button 26 and the voltage signal generating unit 60. In this example, the shooting button 26 has the pressing member 68 which slides in a hole provided in a portion protruded from a center of a bottom of the shooting button 26. The hitting force applied onto the pressing button 26 is transmitted to the voltage signal generating unit 60 via a spring.

In the dice throwing mechanism 114, the powder clutch 46 transmits a torque in response to the current supplied thereto. That is, when the magnitude of the hitting force is not sufficient, the current supplied to the powder clutch 46 is not sufficient to fully activate the electromagnetic powder clutch 46. Accordingly, a rotational force (torque) of the AC motor 44 is transmitted to the pulley C2 of the power output side of the electromagnetic powder clutch 46 with a slippage. The torque transmitted through the electromagnetic powder clutch 46 is then transmitted to the shaft 52 via the timing belt B and the timing belt A. Thus, the throwing plate 42 mounted to the shaft 52 is rotated, and thus the dice placed on the throwing plate 42 are thrown toward the field 24. Accordingly, the throwing power of the dice corresponds to the magnitude of the current supplied to the electromagnetic powder clutch 46.

After the electromagnetic powder clutch 46 is activated, it is determined, in S38, whether the throwing plate 42 has reached the end position. If the throwing plate 42 does not reach the end position in a predetermined time period, the routine proceeds to S32 where the error signal is output. If it is determined that the throwing plate 42 has reached the end position, the AC motor 44 is then reversed, in S40, so as to return the throwing plate 42 to the home position, and then the routine is ended.

In the above-mentioned throwing operation, the AC motor 44 is rotated in S26 before the shooting button 26 is hit. This is to eliminate a starting time of the AC motor 44. That is, a response time period from the hitting of the shooting button 26 to the throwing of the dice can be reduced. Additionally, the response time period is reduced by supplying the small current in S28. That is, an initial magnetization in the electromagnetic powder clutch 46 is performed beforehand to reduce a raising time of the magnetization in the electromagnetic powder clutch 46. In the present embodiment, an intensity of the small current supplied to the electromagnetic powder clutch 46 is a few milliamperes.

Figure 14:
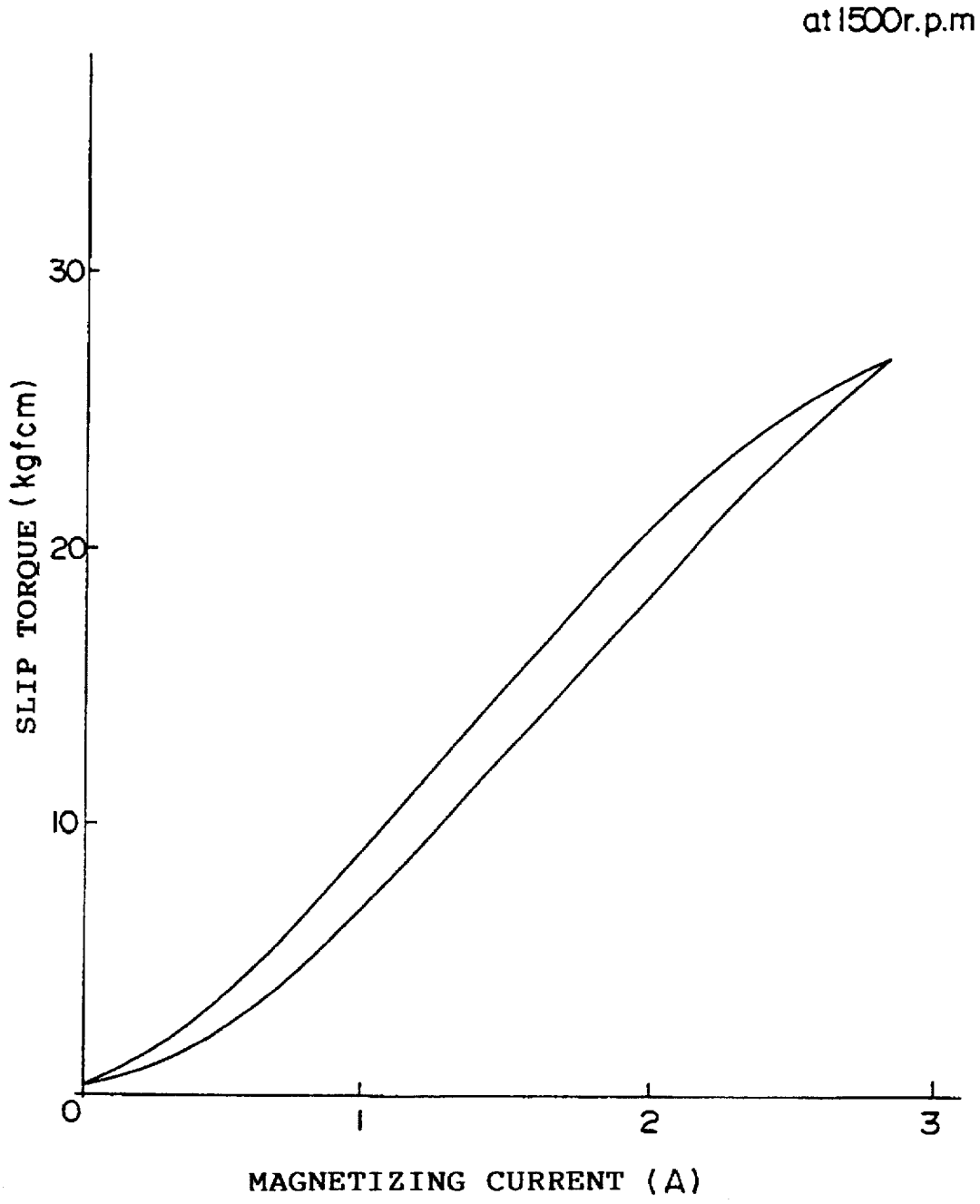
FIG. 14 is a graph showing a relationship between a magnetizing current and a slip torque of the electromagnetic powder clutch.

FIG. 14 is a graph showing a relationship between a magnetizing current and a slip torque of the electromagnetic powder clutch 46. As shown in FIG. 14, the slip torque of the electromagnetic powder clutch 46 is in proportion to the magnetizing current supplied to the electromagnetic powder clutch 46. Thus, a slip torque proportional to the magnetizing current is obtained. In the present embodiment, the magnetizing current is varied in a range from a few milliamperes to about 2.5 amperes so as to control the magnitude of the throwing force.

As mentioned above, the dice throwing mechanism 114 can throw the dice in a very short time, and the throwing force of the dice can be controlled by varying the magnitude of the hitting force applied to the shooting button 26. Thus, the shooter can play the game as if the shooter throws the dice by the shooter's own hand.

It should be noted that the dice throwing mechanism is not limited to the specifically disclosed embodiment, and other mechanisms which can vary a throwing force according to an action of the shooter may instead be used. For example, a throwing mechanism may be used which uses a photosensing system comprising a light-emitting element and a photosensor. The photo sensing system detects a passage of the shooter's hand at two predetermined points. A time difference between the two points is calculated and the throwing force of the dice is controlled according to the time difference. That is, the throwing force of the dice is controlled by a moving speed of the shooter's hand.

Additionally, the throwing force may be generated by ejection of air from an air compressor. In this case, the throwing force can be varied by a pressure control valve provided on a air passage between the compressor and an eject nozzle.

A description will now be given of the dice collecting mechanism 113. The dice collecting mechanism 113 basically comprises a collecting mechanism, a fillip mechanism and an attracting mechanism. The collecting mechanism moves the dice on the field 24 toward the slope 30 (refer to FIG. 6). The fillip mechanism drops one of the dice off of the other when the dice on the slope 30 are positioned on top of each other so that the dice are positioned side by side. The attracting mechanism collects the dice on the bottom side of the slope 30 in the center of the bottom side of the slope 30.

The collecting mechanism comprises a collect bracket 70 which moves in a direction indicated by an arrow Y in FIG. 6 and parallel to a surface of the field 24. The collect bracket 70 is positioned in a rear position, which is opposite to the slope 30, when the dice are thrown. When the detection of the resultant number is completed after the dice are thrown onto the field 24, the collect bracket 70 moves toward the slope 30 (in the Y direction) while pressing the dice on the field 24.

Figure 15:
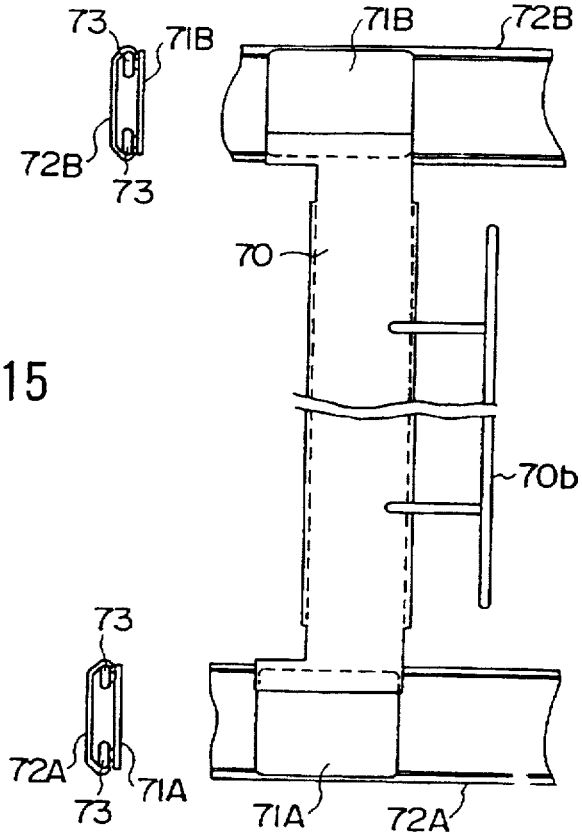
FIG. 15 is a plan view of a collecting bracket and parts of rails provided in a dice collecting mechanism shown in FIG. 6.

A pair of rails 72A and 72B are arranged on the left side and the right side of the field 24, respectively. Timing belts 74A and 74B are provided inside the respective rails 72A and 72B. The timing belt 74A is supported by pulleys 76A and 78A at its opposite ends. The timing belt 74B is supported by pulleys 76B and 76C at its opposite ends. As shown in FIG. 15, slide plates 71A and 71B are attached to one side of each of the timing belts 74A and 74B, respectively. The slide plates **71*a* and 71B are slidable along the respective rails 72A and 72B. Opposite ends of the collect bracket 70 are mounted to the respective slide plates 71A and 71B. Thus, the collect bracket 70 moves parallel to the surface of the field 24**.

As shown in FIG. 15, each of the rails 72A and 72B has a cross section having a channel-like shape. Side walls of each of the rails 72A and 72B protrude outwardly. A plurality of roller bearings 73 are provided on a bottom surface of each of the slide plates 71A and 71B. The roller bearings are placed against the side walls of the rails 72A and 72B so that the each of the slide plates 71A and 71B can freely slide along the respective slide rails 72A and 72B.

Figure 16:
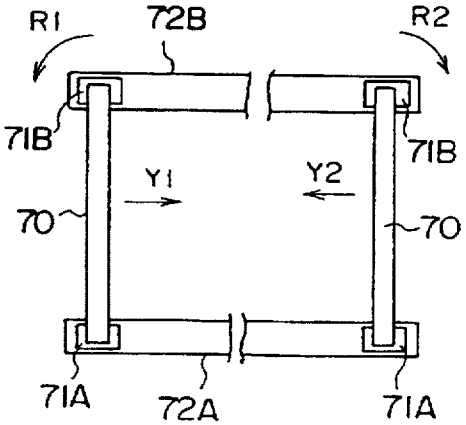
FIG. 16 is an illustration for explaining a moment applied to a slide plate provided in the dice collecting mechanism shown in FIG. 6.

A description will now be given of a reason why each of the slide plates is separately driven by the respective timing belts 74A and 74B. FIG. 16 is an illustration of the rails 72A and 72B and the collect bracket 70. In FIG. 16, it is assumed that only the slide plate 71A is driven, and the slide plate 71B is freely moved. When the collect bracket 70 is moved in a direction indicated by an arrow Y1 as shown in the left part of FIG. 16, a moment indicated by an arrow R1 is applied to the slide plate 71B. When the collect bracket 70 is moved in a direction indicated by an arrow Y2 as shown in the right part of FIG. 16, a moment indicated by an arrow R2 is applied to the slide plate 71B. If a moment such as the moment R1 or R2 is applied to the slide plate 71B, an excessive side force is applied to the roller bearings 73 of the slide plate 71B. This prevents a smooth sliding operation of the slide plate 71B, and thus a service life of the bearings 73 becomes extremely short. In order to eliminate such a problem, both of the slide plates 71A and 71B are synchronously driven by the respective timing belts 74A and 74B.

As shown in FIG. 6, the timing belt 74A to which the slide plate 71A is mounted is driven by a pulley 78A which is rotated by an AC motor 84. A pulley 78B which drives the timing belt 74B is rotated by a timing belt 80 provided between the pulley 78A and the pulley 78B. Accordingly, the timing belts 74A and 74B are moved in synchronization with each other. A tension of the timing belt 30 is adjusted by an idle pulley 82.

The above-mentioned AC motor 84 is a reversible type AC motor with a four-pole/two-pole switching function. When moving the dice, the AC motor 84 is switched to a four-pole drive to generate a high torque. When the collect bracket is returned to a rear position, the AC motor 84 is switched to a two-pole drive to obtain a high speed. Accordingly, the collect bracket 70 is moved faster when the collect bracket 70 is returned, and thus a waiting time due to the return of the collect bracket 70 is reduced.

Figure 17A:
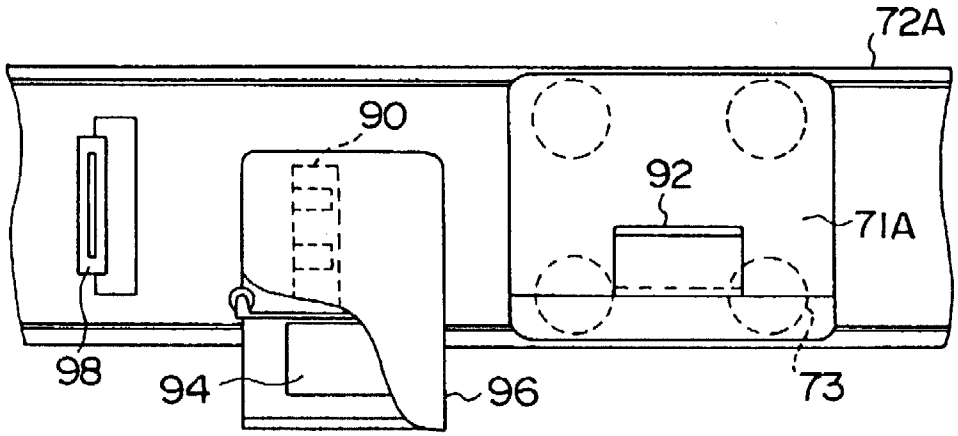
FIG. 17A is a plan view of a portion of the rail and the slide plate shown in FIG. 6.
Figure 17B:
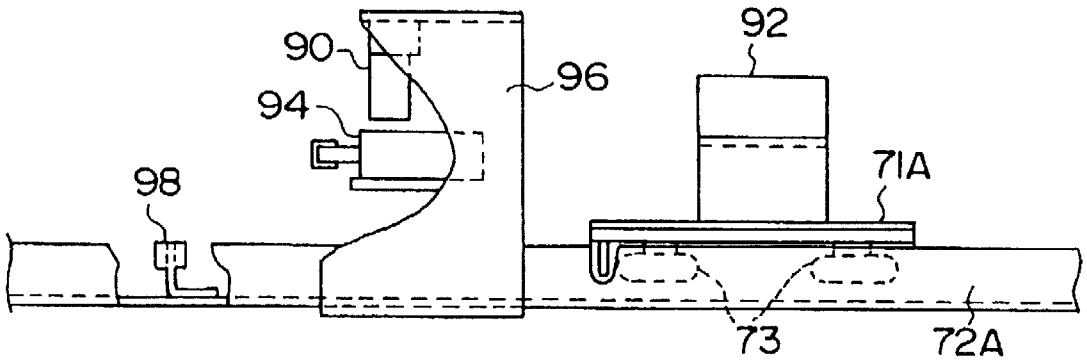
FIG. 17B is a front view of the portion of the rail and the slide plate 71A shown in FIG. 17A.
Figure 17C:
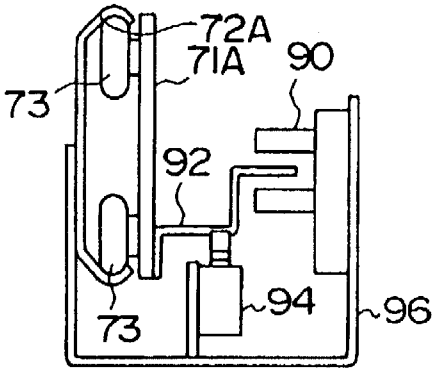
FIG. 17C is a side view of the portion of the rail and the slide plate shown in FIG. 17A.

Sensors are provided on opposite ends of the rail 72A so as to detect the slide plate 71A and to stop the AC motor 84. FIG. 17A is a plan view of a portion of the rail 72*a* and a slide plate 71A; FIG. 17B is a front view of the portion of the rail 71A and the slide plate 71A shown in FIG. 17A; FIG. 17C is a side view of the portion of the rail 72A and the slide plate 71A shown in FIG. 17A. A sensor 90 comprising a photointerrupter is mounted to a rail 72A via a bracket 96 near both ends of the rail 72A. A position of each sensor 90 corresponds to an end of the stroke of the slide plate 71A. A sensor bracket 92 is provided on the slide plate 71A. An end of the sensor bracket 92 protrudes into the slit of each sensor 90 when the slide plate 71A moves to the respective end of the stroke. The end of the sensor bracket 92 interrupts an optical path of each sensor 90, and thereby it is detected that the slide plate 71A is moved to the end of the stroke. A rotation of the AC motor 84 is stopped according to the detection of the slide plate 71A in a software manner.

Additionally, a limit switch 94 is provided to stop the rotation of the AC motor 84 in a hardware manner. The limit switch 94 is operated, when an arm of the limit switch 94 is pressed by a portion of the sensor bracket 92, so as to interrupt a current supplied to the AC motor 84. That is, if the AC cannot be stopped by means of the sensor 90, the limit switch 94 interrupts the current to the AC motor 84 to stop the AC motor 84. Accordingly, the limit switch 94 is positioned behind the sensor 90 so that the limit switch 94 is not operated during a normal operation. In the present embodiment, a stopper 98 is further provided at each end of the rail 72A to mechanically stop the movement of the slide plate 71A. Accordingly, if the slide plate 71 should move continuously after passing the limit switch 94, the slide plate 91A is forcibly stopped by the stopper 98. The stopper 98 is also provided to both ends of the rail 92B.

As mentioned above, the AC motor 84 which drives the slide plates 72A and 72B is stopped at the end of the stroke by the software control and then the hardware control. Thus, the AC motor 84 is stopped even when an error occurs in the software control. If the limit switch 94 is not provided to stop the AC motor 84 by the hardware control, a coil of the AC motor may burn out due to an overload when the slide plates 71A and 71B are mechanically stopped. The present embodiment prevents such a problem by using the double stop system comprising the software control and the hardware control.

A description will now be given of a function of a collect bar 70*a* (refer to FIG. 6). In a case where two dice are thrown as in the dice game machine 10, there is a possibility that one of the dice is positioned on the other. The collect bar 70*a* is provided to drop the upper die from the lower die.

Figure 18:
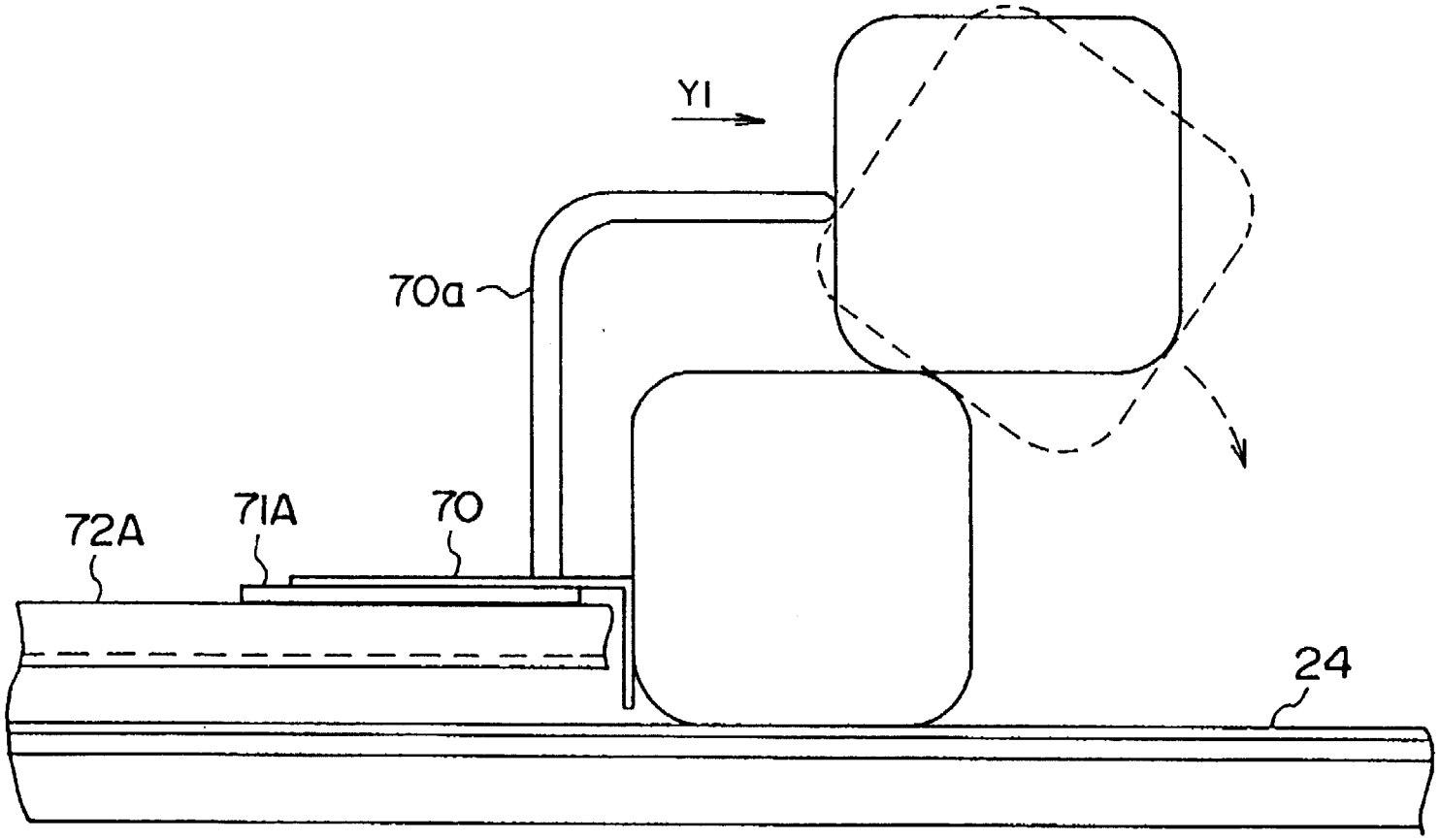
FIG. 18 is a side view of a collect bar shown in FIG. 6.

FIG. 18 is a side view of the collect bar 70*a*. The collect bar 70*a* protrudes from a front side of the collect bracket 70 at a height which is greater than a height of one of the dice. A distance from the front side of the collect bracket 70 to a protruding end of the collect bar 70*a* is greater than a length of one half of a diagonal line of a face of one of the dice. Accordingly, the upper one of the dice positioned on the other is dropped onto the field 24 before the lower one of the dice is moved by the collect bracket 70.

Figure 19:
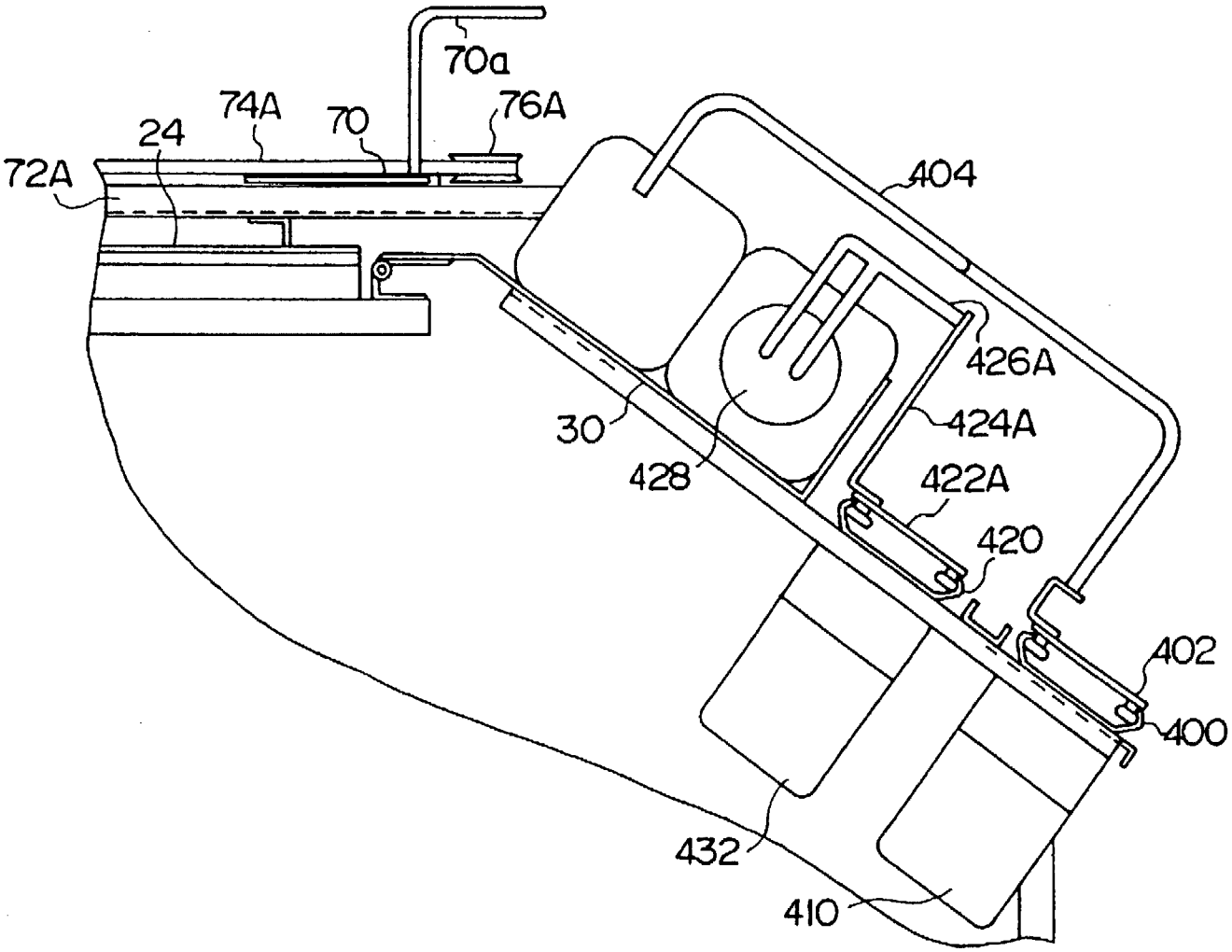
FIG. 19 is a side view of a fillip mechanism and an attracting mechanism shown in FIG. 6.

A description will now be given of the fillip mechanism. FIG. 19 is a side view of the fillip mechanism and the attracting mechanism.

The fillip mechanism includes a fillip bar 404 which is mounted on a slide plate 402 which slides along a rail 400 as shown in FIGS. 6 and 19. The fillip bar 404 is provided to drop an upper die to a bottom side of the slope 30 when two dice are aligned in a longitudinal direction on the slope 30 as shown in FIG. 19. The slide plate 402 is moved along the rail 400 by a mechanism similar to that of the above-mentioned collect mechanism. That is, the mechanism comprises the rail 400, pulleys 406 and 408, a motor 410 which drives the pulley 406 and a timing belt 412 which is provided between the pulleys 406 and 408.

Figure 20:
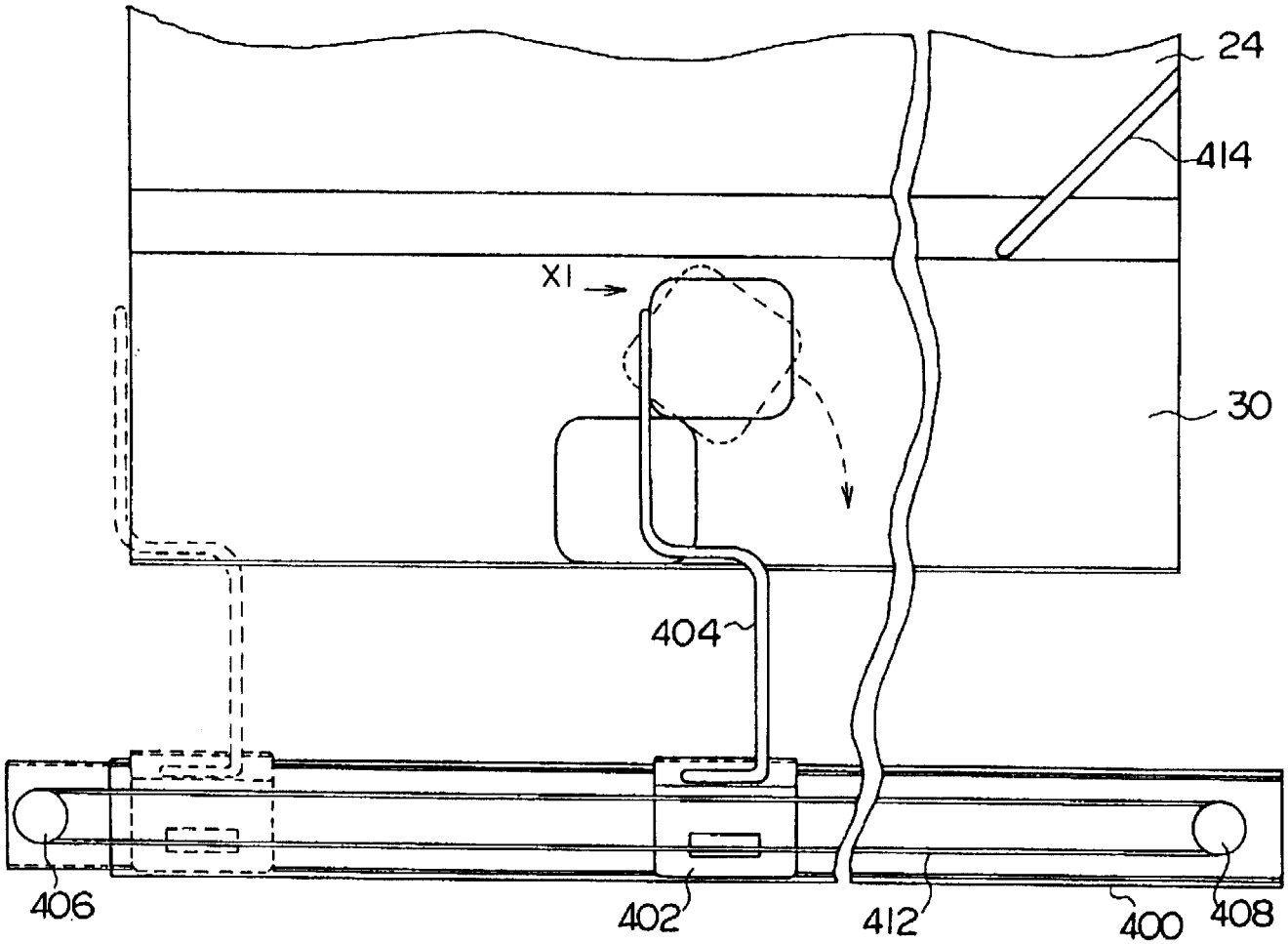
FIG. 20 is a plan view of the fillip mechanism shown in FIG. 19.

FIG. 20 is a plan view of the fillip mechanism. As shown in FIG. 20, the fillip bar 404 is moved from a home position (indicated by dotted lines) in a direction indicated by an arrow X1 to traverse the slope 30. If the two dice are aligned one on the other in a longitudinal direction of the field 24, the upper one is pushed off of the lower one by an end of the fillip bar 404. Thus, the two dice are aligned at the bottom of the slope side by side. If the two dice are aligned in the longitudinal direction at a side opposite to the home position, the fillip mechanism is not effective. In order to eliminate this problem, a thin bar 414 is provided on the side opposite to the home position side as shown in FIG. 20. The thin bar 414 protrudes from the side opposite to the home position side by a distance which is equal to or more than a length of a side of one of the dice. Due to an action of the thin bar 414, the dice are always positioned at the bottom side of the slope 30 at a distance away from the side opposite to the home position side, the distance being at least the length of the side of one of the dice.

The fillip bar 404 is moved from the home position to the opposite side of the slope 30 (end position), and then returned to the home position. The slide plate 402 positioned at the home position and the end position is detected by sensors provided on the rail 400 in the same manner as the detection of the collect bracket 70.

Figure 21B:
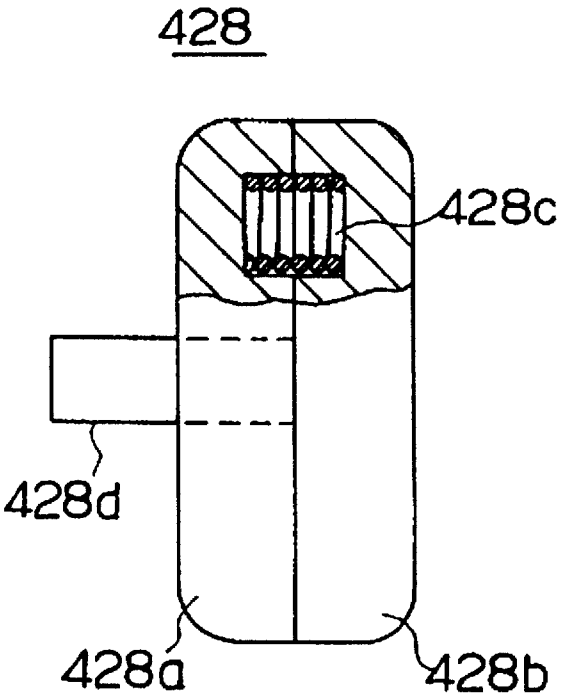
FIGS. 21A and 21B are partially cut-away cross-sectional views of a pad provided in the attracting mechanism shown in FIG. 19.
Figure 21A:
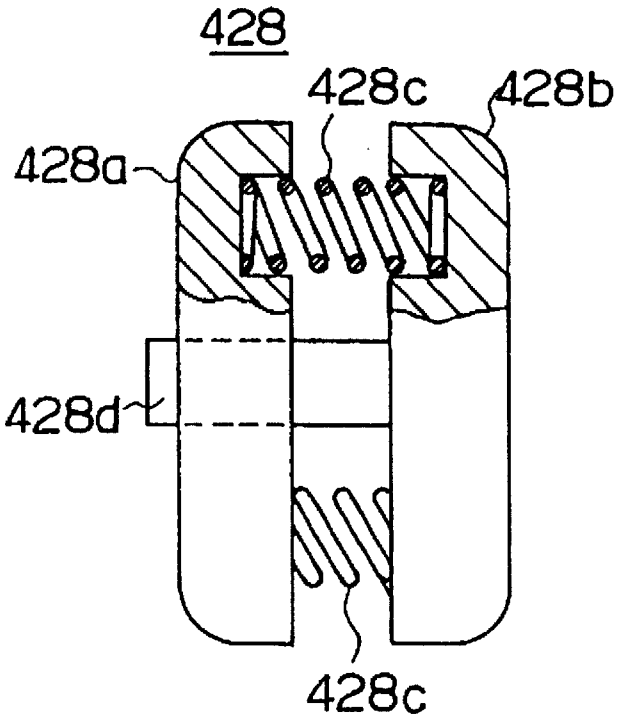

A description will now be given of the attracting mechanism. The attracting mechanism includes a pair of attract bars 426A and 426B which are mounted on slide plates 422A and 422B via brackets 424A and 424B, respectively, as shown in FIGS. 6 and 19. The slide plates 422A and 422B slide along a rail 420 in opposite directions to each other. A pad 428 shown in FIGS. 21A and 21B is attached on an end of each of the attract bars 426A and 426B. The dice are collected to a center of the bottom side of the slope 30, where the throwing plate 42 is located, by the movement of the pads 428.

Figure 22:
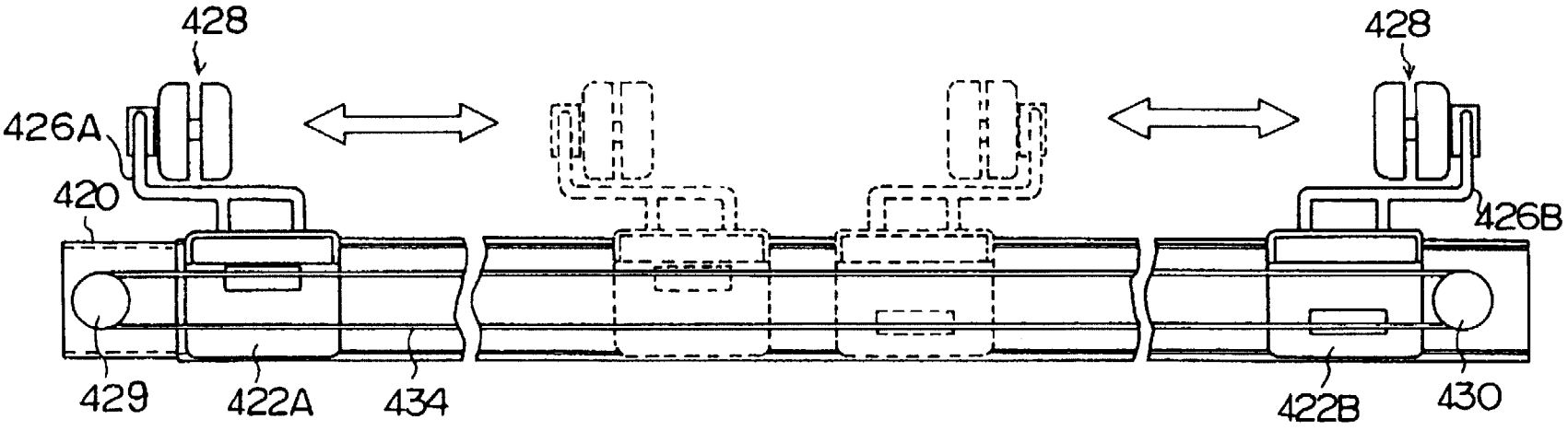
FIG. 22 is a plan view of the attracting mechanism shown in FIG. 6.

The slide plates 422A and 422B are moved by a mechanism similar to that provided in the collect mechanism. That is, the mechanism of the fillip mechanism comprises the rail 420, pulleys 429 and 430 which are provided at opposite ends of the rail 420, a motor 432 which drives the pulley 429 and a timing belt 434 provided between the pulleys 429 and 430. Since the slide plates 422A and 422B are mounted on opposite sides of the timing belt 434, respectively, the slide plates 422A and 422B move in opposite directions to each other. In FIG. 22, end positions of the pads 428 and the respective slide plates 422A and 422B are indicated by dotted lines, and home positions thereof are indicated by solid lines. When the slide plates 422A and 422B are at end positions, respectively, the dice are collected to the center of the slope 30. Thus the dice are placed on the throwing plate 42 of the dice throwing mechanism. The slide plates 422A and 422B positioned at the respective end positions and at the respective home positions are detected by sensors provided on the rail 420 in the same manner as the detection of the collect bracket 70.

The pad 128 comprises two discs 428*a* and 428*b* and springs 128*c* provided between the discs 428*a* and 428*b* as shown in FIGS. 21A and 21B. The disc 428*a* has an opening in the center thereof, and the disc 428*b* has a shaft 428*d* protruding from the center thereof. The shaft 428*d* of the disc 428*b* fits in the opening of the disc 428*a* so that the disk 428*a* can move with respect to the disk 428*b* with an elastic force generated by the springs 128*c*. Accordingly, the dice are pinched by the pads 128 softly which prevents the dice from being damaged by a pressing force of the pads 428. Instead of the above-mentioned mechanism using springs 428*c*, the pads 428 may be made of an elastic material such as rubber or sponge which also provides an elastic force.

Figure 23:
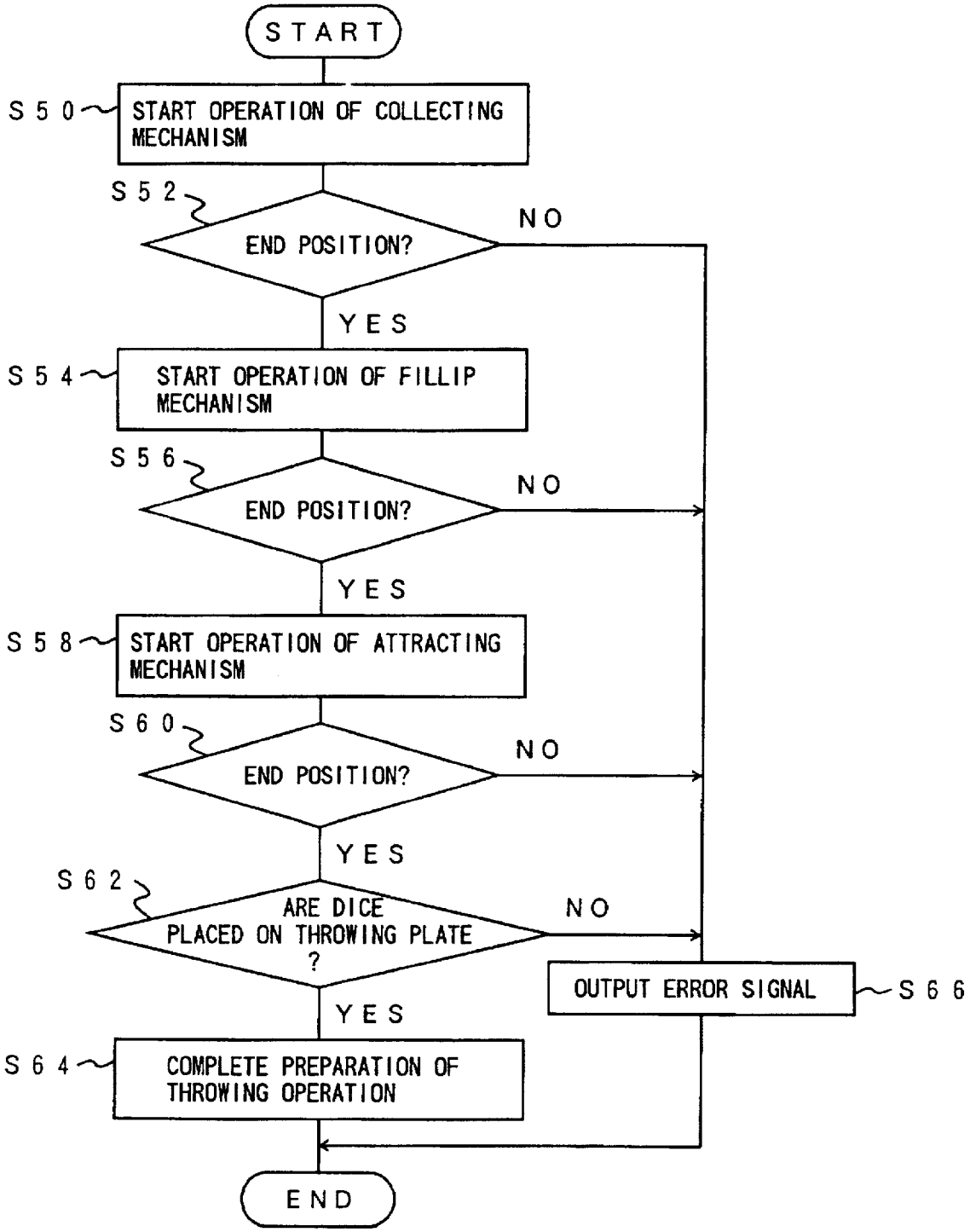
FIG. 23 is a flowchart of an operation of the dice collecting mechanism shown in FIG. 6

A description will now be given, with reference to FIGS. 6 and 23, of an operation of the dice collecting mechanism 113. FIG. 23 is a flowchart of the operation of the dice collecting mechanism 113.

The operation of the dice collecting mechanism 113 is started after the dice are thrown toward the field 24 and the resultant number indicated by each of the dice is detected. First, the operation of the collecting mechanism is started in S50. The collect bracket 70 is moved along the field 24 from the home position toward the slope 30. The two dice on the field 24 are moved by the collect bracket 70. If one of the dice is positioned on the other one of the dice, the upper one is dropped off to the field 24 by the collect bar 70*a*.

It is determined, in S52, whether or not the collect bracket has reached the end position. This determination is made according to the detection of the slide plate 71A by the sensor 90 shown in FIGS. 17A, 17B and 17C. If the collect bracket 70 does not reach the end position within a predetermined time period after the operation of the collecting mechanism was started, an error signal is output, in S66, so that the operation of the dice collecting mechanism 113 is stopped. When the collect bracket 70 reaches the end position, the dice are moved to the slope 30, and thus the dice are slid down to the bottom side of the slope 30.

The operation of the fillip mechanism is then started, in S56, so as to move the fillip bar 404 from the home position, which is on one side of the slope 30, to the end position which is on the opposite side of the slope 30. If the two dice are aligned in the longitudinal direction of the field 24, the upper one of the dice is dropped by the fillip bar 404. It is then determined, in S56, whether or not the fillip bar has reached the end position.

If the fillip bar 404 does not reach the end position within a predetermined time period after the operation of the fillip mechanism was started, an error signal is output, in S66, so that the operation of the dice collecting mechanism 113 is stopped. When it is determined that the fillip bar 404 has reached the end position, the operation of the attracting mechanism is started in S58. At this time, the collect bracket 70 and the fillip bar 404 are returned to their home positions.

It is then determined, in S60, whether or not the attract bars 126A and 126B have reached their end positions. If the attract bars 126A and 126B do not reach their end positions within a predetermined time period after the operation of the attracting mechanism was started, an error signal is output, in S66, so that the operation of the dice collecting mechanism 113 is stopped. When it is determined that the attract bars 126A and 126B have reached the end positions, it is determined, in S62, whether or not the two dice are placed on the throwing plate 42. This determination is made according to signals from the photosensors C provided in the dice throwing mechanism 114. If it is determined that the two dice are placed on the throwing plate 42, it is determined, in S64, that a preparation for throwing the dice has been completed, and then the operation is ended.

It should be noted that the determinations in the above-mentioned operation are performed by the CPUs for controlling the operation of the dice game machine 10. Additionally, instead of outputting the error signal in S66, the operation of the dice collecting mechanism may be repeated from S50.

In the above-mentioned dice game machine 10, it is preferable that the field 24 has a large area so that the dice can freely roll on the field 24. This is because the players have guessed the resultant number and get excited while the dice are freely rolled until the dice finally stop. This provides enjoyment to the game performed by the dice game machine 10 according to the present invention. Accordingly, it is preferable that the dome 22 which covers the field 24 is has a sufficient height so that the dice do not hit the dome 22 before they hit the wall provided on a rear side of the field 24. Additionally, it is preferable that the movement of the dice can be observed by all of the players standing in front of the satellites 18.

Although the present embodiment is described by using the dice game machine 10 which uses two dice, a single die may be used. Additionally, a die-like object having, for example, a polyhedron shape may be used as an element which determines the resultant number. A flat piece such as a coin may also be used as means for determining a game result. The concept of the dice throwing mechanism may be applied to a ball throwing mechanism of a roulette game machine.

The present invention is not limited to the specifically disclosed embodiments, and variations and modifications may be made without departing from the scope of the present invention.

What is claimed is:

1. A game apparatus capable of performing a game played with a plurality of players, said game apparatus comprising;

at least one operation means for generating magnitude information indicative of a magnitude determined by one of the players, said operation means being manually operated by the one of the players so that the magnitude indicated by the magnitude information is arbitrary varied by the one of the players;

detecting means electrically detecting the magnitude information generated by said operation means;

at least one object having means for determining a result of the game, the result of the game being dependent on a movement of said object, a moving process of said object being observed by the players; and driving means for applying a driving force to said object so that said objects is moved, a magnitude of said driving force being controlled in accordance with the magnitude information electrically detected by said detecting means and outputted to the driving means.

2. The game apparatus as claimed in claim 1, wherein said operation means comprises a button which is hit by the one of the players, and said detecting means comprises a piezoelectric element which converts a hitting force applied to said button into an electric signal indicative of a magnitude of the hitting force.

3. The game apparatus as claimed in claim 1, wherein said driving means comprises a driving power source, a driving member and a driving force transmitting means, said driving power source generating the driving force having a predetermined constant power, said driving member applying the driving force to said object, said driving force transmitting means transmitting the driving force from said driving power source to said driving member while reducing a power of the driving force in accordance with the magnitude information.

4. The game apparatus as claimed in claim 3, wherein said driving power source comprises a motor generating a rotational force, said driving force transmitting means comprises an electromagnetic powder clutch, said driving member comprising a pivotable member, the rotational force generated by said motor being transmitted to said pivotable member via said electromagnetic powder clutch so that the driving force is applied to said object by a pivoting action of said pivotable member, the power of the driving force being controlled by varying a slip torque of said electromagnetic powder clutch.

5. The game apparatus as claimed in claim 1, further comprising means for prohibiting an operation of said driving means when the magnitude indicated by the magnitude information detected by said detecting means is out of a predetermined range.

6. The game apparatus as claimed in claim 1, further comprising means for displaying the magnitude indicated by the magnitude information input through said operation means so that at least the one of the players who operates said operation means visually recognizes the magnitude.

7. The game apparatus as claimed in claim 6, wherein said means for displaying the magnitude comprises a plurality of lighting elements, a number of the lighting elements which are lighted being varied in accordance with the magnitude information.

8. The game apparatus as claimed in claim 1, wherein said object comprises a die, and the result of the game is determined in accordance with a number indicated on a face of said die.

9. The game apparatus as claimed in claim 8, further comprising a field on which said die is rolled, the result of the game being determined in accordance with the number indicated on the face of said die on said field which face is opposite to a face contacting a surface of said field.

10. The game apparatus as claimed in claim 9, further comprising means for detecting the number indicated on the face of said die, and means for determining the result of the game for each of the players in accordance with the number.

11. A game apparatus for playing a game of chance, wherein a die for providing a score is thrown onto a controlled playing field, comprising;

a playing field for supporting the die;

a plurality of player satellite stations positioned around the playing field to enable a subjective input of playing interaction by each player, including a shooting control member for varying the throwing force applied to the die;

detecting means for electrically detecting the magnitude of throwing force of the shooting control member;

means for collecting the die from the playing field;

means for determining a score of the thrown die and displaying the score; and throwing means for projecting the die with a variably determined force, set in accordance with an output from the detecting means, whereby the player satellite station enabled to control the projection of the die will enable its shooting control member to be activated by the player and the interaction of the player will determine projection force applied by the throwing means to the die.

12. The game apparatus as claimed in claim 11 wherein the throwing means includes a throwing member, a motor rotating at a constant speed, and an electromagnetic clutch operatively provided to engage the throwing member with the motor, wherein the shooting control member can vary a current applied to the electromagnetic dutch to vary the speed of movement of the throwing member.

13. The game apparatus as claimed in claim 12 wherein the electromagnetic clutch is an electromagnetic powder clutch which transmits a rotational output from the motor in proportion to the intensity of current applied to the electromagnetic powder clutch.

14. The game apparatus as claimed in claim 12 further including a power transmission mechanism between the motor and the electromagnetic clutch and between the electromagnetic clutch and the throwing member, the throwing member including pulleys having teeth on an outer surface thereof and timing belts having projections which engage with the teeth.

15. The game apparatus as claimed in claim 11 wherein the shooting control member includes a shooting button and a piezoelectric element, a voltage signal being output from the piezoelectric element when the piezoelectric element is pressed by the shooting button, the voltage of the voltage signal being controlled by varying a magnitude of a hitting force applied to the shooting button.

16. The game apparatus as claimed in claim 15 further comprising a plurality of lighting elements arranged around the shooting button, the number of lighting elements which are lighted are varied in accordance with the magnitude of the hitting force applied to the shooting button.

17. The game apparatus as claims in claim 11 wherein the means for collecting the die includes:

a collecting member moving over the playing field in a longitudinal direction of the playing field from a rear side to a front side so that the die on the playing field is moved toward the front side of the playing field by a movement of the collecting member, the collecting member having a length substantially equal to a width of the playing field, the die being thrown from a predetermined position at the front side of the playing field; and a pair of attracting members, provided at the front side of the playing field, moving perpendicular to the longitudinal direction in opposite directions to each other, the die being sandwiched between the attracting members and placed at a predetermined position on the playing field.

18. The game apparatus as claimed in claim 17 wherein a pair of dice are thrown and the collecting member includes a protruding member protruding toward the front side of the playing field at a height greater than a height of the dice, a length of the protruding member being substantially equal to a width of the playing field, a protruding distance of the protruding member from a leading edge of the collecting member to an end of the protruding member being greater than one-half of a longest length of a face of the die so that one of the dice is discharged by the protruding member.

19. The game apparatus as claimed in claim 17 wherein the playing field further comprises a slope on the front side of the playing field so that the dice moved by the collecting member slide down to a bottom side of the slope.

20. The game apparatus as claimed in claim 17 wherein a pair of dice are thrown and an extending member is provided on the bottom side of the slope, the extending member moving from one side of the slope to the other side of the slope, the extending member extending at a height greater than the height of the die, an end of the extending member being at a height less than the height of the die so that one of the dice positioned on the other one of the dice is dropped off by the end of the extending member.

21. The game apparatus as claimed in claim 17 wherein a pair of rails are provided on both sides of the playing field, respectively, a slide plate being slidably provided on each of the rails, opposite ends of the collecting member being fixed on the respective slide plates, the slide plates moving in synchronization to each other.

22. The game apparatus as claimed in claim 21 wherein a stopper is provided on each end of at least one of the rails and a first sensor is provided on an inner side of the stopper, a second sensor being provided between the stopper and the first sensor, movement of the slide plate being stopped when the slide plate is detected by the first sensor and when the slide plate is detected by the second sensor, the movement of the slide plate being forcibly stopped when the slide plate collides with the stopper.

23. A game apparatus for playing a game of chance, wherein a die for providing a score is thrown onto a controlled playing field, comprising;

a playing field for supporting the die;

a plurality of player satellite stations positioned around the playing field to enable a subjective input of playing interaction by each player, including a shooting control member for varying the throwing force applied die;

means for collecting the die from the playing field;

means for determining a score of the thrown die and displaying the score; and throwing means for protecting the die with a variably determined force, whereby the player satellite station enabled to control the projection of the die will enable its shooting control member to be activated by the player and the interaction of the player will determine the specific projection force applied by the throwing means to the die, including a throwing member, a motor rotating at a constant speed, and an electromagnetic clutch operatively provided to engage the throwing member with the motor, wherein the shooting control member can vary a current applied to the electromagnetic clutch to vary the speed of movement of the throwing member.

24. The game apparatus as in claimed claim 23 wherein the electromagnetic clutch is an electromagnetic powder clutch which transmits a rotational output from the motor in proportion to the intensity of current applied to the electromagnetic powder clutch.

25. The game apparatus as claimed in claim 23 further including a power transmission mechanism between the motor and the electromagnetic clutch and between the electromagnetic clutch and the throwing member, the throwing member including pulleys having teeth on an outer surface thereof and timing belts having projections which engage with the teeth.

26. A game apparatus for playing a game of chance, wherein a die for providing a score is thrown onto a controlled playing field, comprising;

a playing field for supporting the die;

a plurality of player satellite stations positioned around the playing field to enable a subjective input of playing interaction by each player, including a shooting control assembly for varying the throwing force applied to the die, including a shooting button and a piezoelectric element, a voltage signal being output from the piezoelectric element when the piezoelectric element is pressed by the shooting button, the voltage of the voltage signal being controlled by varying a magnitude of a hitting force applied to the shooting button;

means for collecting the die from the playing field;

means for determining a score of the thrown die and displaying the score; and throwing means for projecting the die with a variably determined force, whereby the player satellite station enabled to control the projection of the die will enable its shooting control member to be activated by the player and the interaction of the player will determine the specific projection force applied by the throwing means to the die.

27. The game apparatus as claimed in claim 26, further comprising a plurality of lighting elements arranged around the shooting button, the number of lighting elements which are lighted are varied in accordance with the magnitude of the hitting force applied to the shooting button.

28. A game apparatus for playing a game of chance wherein a die for providing a score is thrown onto a controlled playing field, comprising;

a playing field for supporting the die;

a plurality of player satellite stations positioned around the playing field to enable a subjective input of playing interaction by each player, including a shooting control member for varying the throwing force applied to the die;

means for collecting the die from the playing field, including a collecting member moving over the playing field in a longitudinal direction of the playing field from a rear side to a front side so that the die on the playing field is moved toward the front side of the playing field by a movement of the collecting member, the collecting member having a length substantially equal to a width of the playing field, the die being thrown from a predetermined position at the front side of the playing field; and a pair of attracting members, provided at the front side of the playing field, moving perpendicular to the longitudinal direction in opposite directions to each other, the die being sandwiched between the attracting members and placed at a predetermined position on the playing field;

means for determining a score of the thrown die and displaying the score; and throwing means for projecting the die with a variably determined force, whereby the player satellite station enabled to control the projection of the die will enable its shooting control member to be activated by the player and the interaction of the player will determine the specific projection force applied by the throwing means to the die.

29. The game apparatus as claimed in claim 28 wherein a pair of dice are thrown and the collecting member includes a protruding member protruding toward the front side of the playing field at a height greater than a height of the dice, a length of the protruding member being substantially equal to a width of the playing field, a protruding distance of the protruding member from a leading edge of the collecting member to an end of the protruding member being greater than one-half of a longest length of a face of the die so that one of the dice is discharged by the protruding member.

30. The game apparatus as claimed in claim 28 wherein the playing field further comprises a slope on the front side of the playing field so that the dice moved by the collecting member slide down to a bottom side of the slope.

31. The game apparatus as claimed in claim 28 wherein a pair of dice are thrown and an extending member is provided on the bottom side of the slope, the extending member moving from one side of the slope to the other side of the slope, the extending member extending at a height greater than the height of the die, an end of the extending member being at a height less than the height of the die so that one of the dice positioned on the other one of the dice is dropped off by the end of the extending member.

32. The game apparatus as claimed in claim 28 wherein a pair of rails are provided on both sides of the playing field, respectively, a slide plate being slidably provided on each of the rails, opposite ends of the collecting member being fixed on the respective slide plates, the slide plates moving in synchronization to each other.

33. The game apparatus as claimed in claim 32 wherein a stopper is provided on each end of at least one of the rails and a first sensor is provided on an inner side of the stopper, a second sensor being provided between the stopper and the first sensor, movement of the slide plate being stopped when the slide plate is detected by the first sensor and when the slide plate is detected by the second sensor, the movement of the slide plate being forcibly stopped when the slide plate collides with the stopper.

34. A game apparatus capable of performing a game played with a plurality of players, said game apparatus comprising:

at least one operation means for generating magnitude information indicative of a magnitude determined by one of the players, said operation means being manually operated by the one of the players so that the magnitude indicated by the magnitude information is arbitrary varied by the one of the players, including a button which is hit by one of the players;

detecting means for detecting a magnitude information generated by said operation means, including a piezoelectric element which converts a hitting force applied to said button into an electric signal indicative of magnitude of the hitting force;

at least one object having means for determining a result of the game, the result of the game being dependent on a movement of said object, a moving process of said object being observed by the players; and driving means for applying a driving force to said object so that said object is moved, a magnitude of said driving force being controlled in accordance with the magnitude information detected by said detecting means.

35. A game apparatus capable of performing a game played with a plurality of players, said game apparatus comprising:

at least one operation means for generating magnitude information indicative of a magnitude determined by one of the players, said operation means being manually operated by the one of the players so that the magnitude indicated by the magnitude information is arbitrary varied by the one of the players;

detecting means for detecting the magnitude information generated by said operation means;

at least one object having means for determining a result of the game, the result of the game being dependent on a movement of said object, a moving process of said object being observed by the players; and driving means for applying a driving force to said object so that said object is moved, a magnitude of said driving force being controlled in accordance with the magnitude information detected by said detecting means, including a driving power source, a driving member and a driving force transmitting means, said driving power source generating the driving force having a predetermined constant power, said driving member applying the driving force to said object, said driving force transmitting means transmitting the driving force from said driving power source to said driving member while reducing a power of the driving force in accordance with the magnitude information.

36. The game apparatus as claimed in claim 35 wherein said driving power source comprises a motor generating a rotational force, said driving force transmitting means comprises an electromagnetic powder clutch, said driving member comprising a pivotable member, the rotational force generated by said motor being transmitted to said pivotable member via said electromagnetic powder clutch so that the driving force is applied to said object by a pivoting action of said pivotable member, the power of the driving force being controlled by varying a slip torque of said electromagnetic powder clutch.

37. A game apparatus capable of performing a game played with a plurality of players, said game apparatus comprising:

at least one operation means for generating magnitude information indicative of a magnitude determined by one of the players, said operation means being manually operated by the one of the players so that the magnitude indicated by the magnitude information is arbitrary varied by the one of the players;

detecting means for detecting the magnitude information generated by said operation means;

at least one object having means for determining a result of the game, the result of the game being dependent on a movement of said object, a moving process of said object being observed by the players;

driving means for applying a driving force to said object so that said object is moved, a magnitude of said driving force being controlled in accordance with the magnitude information detected by said detecting means; and means for displaying the magnitude indicated by the magnitude information input through said operation means so that at least the one of the players who operates said operation means visually recognizes the magnitude.

38. The game apparatus as claimed in claim 37 wherein said means for displaying the magnitude comprises a plurality of lighting elements, a number of the lighting elements which are lighted being varied in accordance with the magnitude information.

39. A game apparatus capable of performing a game played with a plurality of players, said game apparatus comprising:

at least one operation means for generating magnitude information indicative of a magnitude determined by one of the players, said operation means being manually operated by the one of the players so that the magnitude indicated by the magnitude information is arbitrary varied by the one of the players;

detecting means for detecting the magnitude information generated by said operation means;

at least one die having means for determining a result of the game, the result of the game being dependent on a movement of said die and a number represented by a face of said die, a moving process of said die being observed by the players;

a field on which said die is rolled, the result of the game being determined in accordance with the number indicated on the fact of said die on said field which face is opposite to a face contacting a surface of said field;

driving means for applying a driving force to said die so that said die is moved, a magnitude of said driving force being controlled in accordance with the magnitude information detected by said detecting means;

means for detecting the number indicated on the face of said die; and means for determining the result of the game for each of the players in accordance with the number.

40. A game apparatus for playing a game of chance, wherein a die for providing a score is thrown onto a controlled playing field, comprising;

a playing field for supporting the die;

a plurality of player satellite stations positioned around the playing field to enable a subjective input of playing interaction by each player, including a shooting control member and hitting force detecting means for converting a manual hitting force applied by a player to the shooting control member into an electrical signal indicative of a magnitude of the hitting force for varying the throwing force applied to the die;

means for collecting the die from the playing field;

means for determining a score of the thrown die and displaying the score; and throwing means for projecting the die with a variably determined force in response to the electrical signal of the shooting control member, whereby the player satellite station enabled to control the projection of the die will enable its shooting control member to be activated by the player and the interaction of the player will determine the specific projection force applied by the throwing means to the die.

* * * * *

UNITED STATES PATENT AND TRADEMARK OFFICE

CERTIFICATE OF CORRECTION

PATENT NO. : 5,707,061

DATED : January 13, 1998

INVENTOR(S) : Yuji Ikeda et al.

It is certified that error appears in the above-identified patent and that said Letters Patent is hereby corrected as shown below:

On the cover page, under [56] References Cited U.S. PATENT DOCUMENTS, please add:

--2,121,838 6/1938 Stewart .....273/145
3,637,208 1/1972 Allred .....273/26E
4,062,222 12/1977 Solheim .....73/13
4,726,585 2/1988 Shoemaker, Jr. .....273/1 GC
4,741,533 5/1988 Michael .....273/144 B
5,071,127 12/1991 Bromley et al..... 273/85 A
5,284,342 2/1994 Tanzer et al. .....272/121 A--

On the cover page, under [56] References Cited FOREIGN PATENT DOCUMENTS, please add:

--1.415.481 9/1965 France
8402281 6/1984 World Int. Prop. O.
426448 5/1991 European Pat. Off.--

Signed and Sealed this

Fifth Day of May, 1998

Bruce Lehman

*Attest:*

BRUCE LEHMAN

*Attesting Officer*

*Commissioner of Patents and Trademarks*